US010219581B2

(12) United States Patent
Holt

(10) Patent No.: US 10,219,581 B2
(45) Date of Patent: Mar. 5, 2019

(54) METHOD AND APPARATUS TO ASSIST FOOT MOTION ABOUT THE PRONATION AXIS

(71) Applicant: Trustees of Boston University, Boston, MA (US)

(72) Inventor: Kenneth G. Holt, Shutesbury, MA (US)

(73) Assignee: Trustees of Boston University, Boston, MA (US)

( * ) Notice: Subject to any disclaimer, the term of this patent is extended or adjusted under 35 U.S.C. 154(b) by 140 days.

(21) Appl. No.: 15/384,571

(22) Filed: Dec. 20, 2016

(65) Prior Publication Data

US 2017/0181495 A1 Jun. 29, 2017

Related U.S. Application Data

(60) Provisional application No. 62/271,756, filed on Dec. 28, 2015.

(51) Int. Cl.
*A43B 13/38* (2006.01)
*A43B 23/00* (2006.01)
(Continued)

(52) U.S. Cl.
CPC ..... *A43B 7/24* (2013.01); *A43B 7/141* (2013.01); *A43B 7/142* (2013.01); *A43B 7/143* (2013.01);
(Continued)

(58) Field of Classification Search
CPC ..... A43B 7/24; A43B 7/141; A43B 7/142; A43B 7/144; A43B 7/1445; A43B 13/145; A43B 13/183; A43B 13/386; A43B 17/006; A43B 17/02; A43B 17/023; A43B 17/04; A61F 5/14
(Continued)

(56) References Cited

U.S. PATENT DOCUMENTS 175,237 A * 3/1876 Burke ..... A43B 7/142 36/166
180,819 A * 8/1876 Ames ..... A43B 7/142 36/167

(Continued)

FOREIGN PATENT DOCUMENTS

FR 2757024 A1 * 6/1998 ..... A43B 7/141
GB 1284967 A * 8/1972 ..... A43B 7/141
WO WO 2015112471 A1 * 7/2015 ..... A43B 7/28

OTHER PUBLICATIONS

International Searching Authority, International Search Report—International Application No. PCT/US2016/067704, dated Feb. 24, 2017, together with the Written Opinion of the International Searching Authority, 17 pages.

*Primary Examiner* — Jameson Collier
(74) *Attorney, Agent, or Firm* — Nutter McClennen & Fish LLP

(57) ABSTRACT

An apparatus that assists foot movement includes a normally twisted plate configured to interact with the foot. The foot has a pronation axis, and the normally twisted plate is biased and configured to twist about a plate axis that substantially approximates the pronation axis in response to a load received from the foot during foot pronation. As the foot pronates, the plate twists to apply a non-linear force substantially about the plate axis.

19 Claims, 20 Drawing Sheets

(51) Int. Cl.

| | |
|---|---|
| ***A43B 7/24*** | (2006.01) |
| ***A43B 7/14*** | (2006.01) |
| ***A43B 17/00*** | (2006.01) |
| ***A43B 17/02*** | (2006.01) |
| ***A43B 17/04*** | (2006.01) |

(52) U.S. Cl.
CPC ..... *A43B 7/144* (2013.01); *A43B 7/1445* (2013.01); *A43B 13/386* (2013.01); *A43B 17/006* (2013.01); *A43B 17/02* (2013.01); *A43B 17/04* (2013.01)

(58) Field of Classification Search
USPC ..... 36/1, 38, 43, 140, 144, 145, 166–168, 36/171, 172, 180
See application file for complete search history.

(56) References Cited

U.S. PATENT DOCUMENTS 989,823 A * 4/1911 Svenson ..... A43B 7/142 36/168
1,741,341 A * 12/1929 Scholl ..... A43B 7/141 36/167
1,750,479 A * 3/1930 Lifschutz ..... A43B 7/142 36/168
1,997,504 A * 4/1935 Wisbrun ..... A43B 7/142 36/180
2,120,055 A * 6/1938 MacDonald ..... A43B 7/144 36/167
2,713,732 A * 7/1955 Guest ..... A43B 7/14 36/167
3,550,597 A * 12/1970 Coplans ..... A43B 13/141 36/144
5,528,842 A * 6/1996 Ricci ..... A43B 13/12 36/103
5,607,756 A * 3/1997 Yamauchi ..... A61F 5/14 12/1 G
6,247,249 B1 * 6/2001 Lindqvist ..... A43B 13/12 36/143
8,146,269 B2 * 4/2012 Mueller ..... A43B 3/0036 36/144
9,066,559 B2 6/2015 Butler ..... 36/43
9,107,473 B2 * 8/2015 Heard ..... A43B 13/14
2002/0162250 A1 11/2002 Campbell et al. ..... 36/166
2003/0061735 A1 * 4/2003 Polifroni ..... A43B 7/141 36/44
2007/0271818 A1 * 11/2007 Rabushka ..... A43B 13/183 36/38
2010/0058613 A1 * 3/2010 Im ..... A43B 13/183 36/12
2010/0175279 A1 * 7/2010 Segel ..... A43B 7/20 36/145
2011/0009982 A1 * 1/2011 King ..... A43B 7/1425 623/53
2011/0314696 A1 12/2011 DeRose ..... 36/44
2015/0150336 A1 * 6/2015 Lawlor ..... A43B 3/26 36/140

* cited by examiner

METHOD AND APPARATUS TO ASSIST FOOT MOTION ABOUT THE PRONATION AXIS

PRIORITY

This patent application claims priority from provisional U.S. Patent Application No. 62/271,756, filed Dec. 28, 2015, "TWISTED PLATE THAT ASSISTS FOOT MOTION AROUND THE PRONATION AXIS," and naming Kenneth G. Holt as inventor, the disclosure of which is incorporated herein, in its entirety, by reference.

FIELD OF THE INVENTION

The invention generally relates to foot movement and, more particularly, the invention relates to controlling foot movement about a prescribed region of the foot.

BACKGROUND OF THE INVENTION

When a person walks, their foot repeatedly pronates and supinates. This is normal. The biomechanics of a person's stride, including their pronation and supination, are largely dependent upon that person's foot structure. Specifically, foot structure at least partially dictates the duration and amplitude of foot pronation and supination. Structural problems of the foot undesirably can lead to unhealthy pronation, which can produce a number of health problems. For example, excessive and prolonged pronation can lead to hip injury.

SUMMARY OF VARIOUS EMBODIMENTS

In accordance with one embodiment of the invention, an apparatus that assists foot movement includes a normally twisted plate configured to interact with the foot. The foot has a pronation axis, and the normally twisted plate is biased and configured to twist about a plate axis that substantially approximates the pronation axis in response to a load received from the foot during pronation. As the foot pronates, the plate twists and applies a non-linear force substantially about the plate axis.

The plate axis may generally be parallel with the pronation axis of the foot. In some embodiments, at least a portion of the plate axis may be coincident with the pronation axis. The twisted plate may assist foot movement by providing a composite force about the subtalar joint, midtarsal joint, and tarsometatarsal joint axes of the foot. The twisted plate may apply force during foot pronation and additionally, or alternatively, during foot supination. For example, the twisted plate may apply force about the pronation axis as the twisted plate unwinds during pronation and as the twisted plate winds during supination. To biomimic the pronation axis, the plate axis may move translationally and rotationally during pronation.

The twisted plate may be configured to provide a force that assists bone movement about the metatarsophalangeal joints. To that end, the twisted plate may have a forefoot portion that is configured to terminate along at least part of the metatarsophalangeal joints when cooperating with the foot. Additionally, or alternatively, the twisted plate may be configured to terminate along at least one of the cuneonavicular joint, the calcaneocuboid joint, and/or the tarsometatarsal joints.

As the twisted plate unwinds, it may store energy. Furthermore, as the plate winds, it may release that stored energy. The force applied by the twisted plate may be at least partially provided by elastic energy built up as the twisted plate unwinds from its normally twisted configuration. Thus, a rearfoot portion of the twisted plate may function as a spring that loads as the foot pronates, and unloads as the foot supinates. Additionally, or alternatively, a forefoot portion of the twisted plate or the entire twisted plate may function as the spring just described. The loading of the spring provides a force that may prevent excessive pronation. For those having late pronation issues, the twisted plate may be configured to provide a force against a front medial side of the foot. For example, this force may be provided during unloading of the spring. Furthermore, the twisted plate may function as a shock absorber.

The twisted plate may take a number of shapes and configurations. For example, the twisted plate may be in the shape of a twisted rectangle. Additionally, in its normally twisted configuration, the plate may be substantially planar at the forefoot portion and twisted at the rearfoot portion.

Among other uses, the twisted plate may be used as a custom foot orthotic, or it may be built into a shoe. For example, the plate may be positioned inside a sole of a shoe. Moreover, the plate may be formed at least in part from a number of materials that facilitate its purposes. For example, the plate may include carbon fiber and/or metal.

In some embodiments, a computer program has code configured to analyze foot data to customize a twisted plate orthotic for the foot. In some cases, the foot may be a human foot. Alternatively, the foot may be a robotic foot, a prosthetic foot, a soft exoskeleton foot, or a hard exoskeleton foot.

In accordance with another embodiment, a method modifies motion of a foot by communicating a normally twisted plate with the foot. In this case, when the foot pronates, it unwinds the normally twisted plate, causing the plate to apply a force against the foot about a plate axis that substantially approximates the pronation axis. When the foot subsequently supinates, the plate also applies the force against the foot. In some embodiments, the force applied is non-linear as a function of the unwinding of the normally twisted plate.

Illustrative embodiments of the invention are implemented as a computer program product having a computer usable medium with computer readable program code thereon. The computer readable code may be read and utilized by a computer system in accordance with conventional processes.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, an orthotic device is configured to assist a person having problems with their gait and/or enhance the gait of a normal foot. To that end, a twisted plate or similar apparatus functions as a leaf spring and is configured to rotate at least generally about the pronation axis of the foot, or an axis that approximates the pronation axis. As known by those in the art, the pronation axis is the axis about which a foot rotates (i.e., pronates and supinates) during normal human movement. Pronation of the foot is caused by the rotation of bones within the foot about the pronation axis. The twisted plate provides a force about the pronation axis, and thus, against pronation during the gait cycle. When the twisted plate is in its wound up (also referred to as "twisted") configuration, it is in its resting configuration. Applying the weight of a human foot to the twisted plate unwinds, or "untwists," the plate, and simultaneously stores energy. This stored energy is returned to the foot, at least generally about the pronation axis, as the heel lifts off and the unwound plate returns to its twisted configuration. Details of illustrative embodiments are discussed below.

Figure 1:
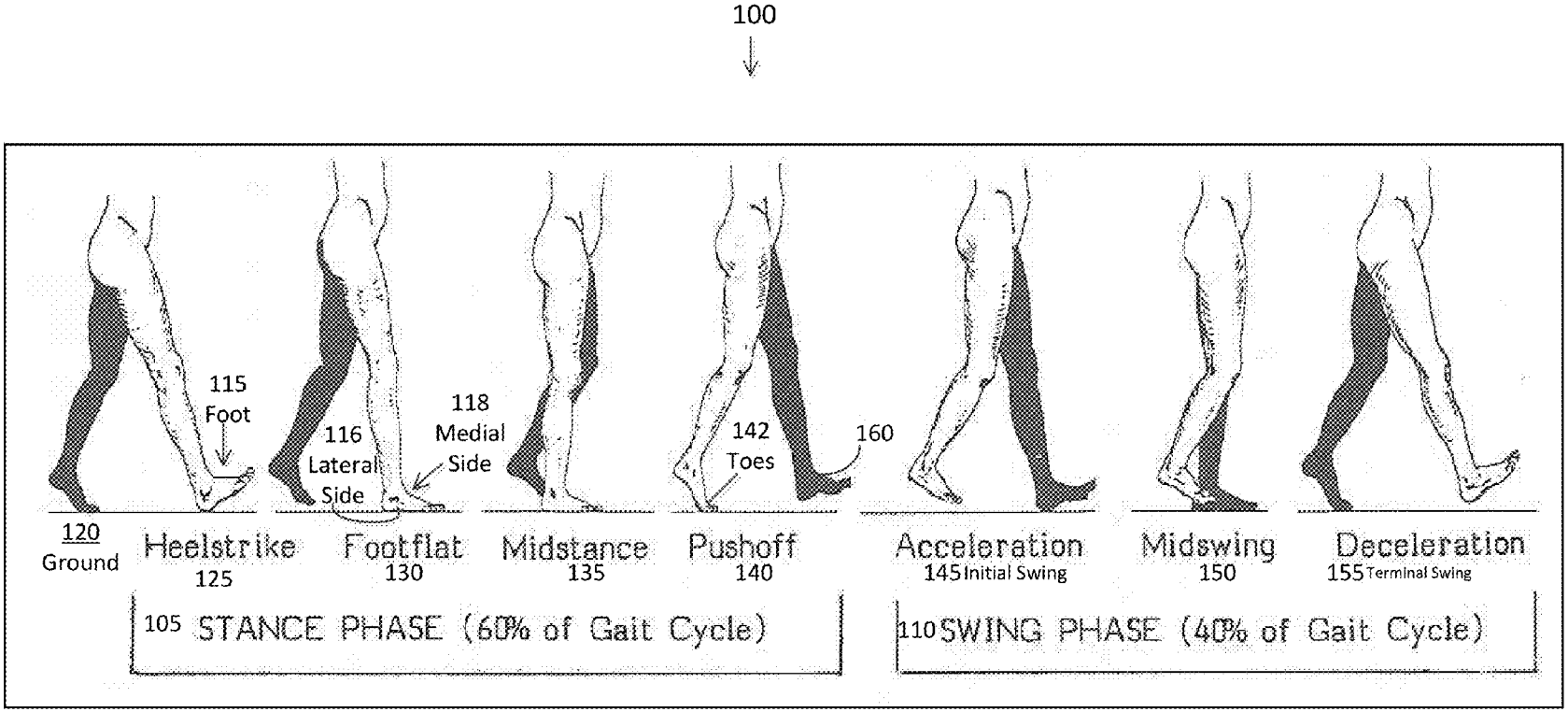
FIG. 1 schematically shows a normal human gait cycle.

FIG. 1 schematically shows a normal human gait cycle, identified by reference number 100. The gait cycle 100 describes the complete sequence of movements in a "normal" human step. Illustrative embodiments of the invention are configured to modify or enhance the natural gait cycle 100. The gait cycle 100 includes a stance phase 105 and a swing phase 110. In the stance phase 105, a foot 115 remains in contact with ground 120. In the swing phase 110, the foot 115 is not in contact with the ground 120, and swings in the air before contacting the ground 120. After the heel of the foot 115 contacts the ground 120, the stance phase 105 begins again. Illustrative embodiments of the invention deal with gait occurring substantially in the stance phase 105.

It should be understood that although reference is made to the foot 115 contacting the ground 120, that the foot 115 is not necessarily in direct contact with the ground 120. Indeed, in illustrative embodiments footwear, orthotics, insoles, socks, twisted plates, etc. and combinations thereof are positioned between the foot 115 and the ground 120, and relay that contact to the foot 115 and the bones within the foot 115. Thus, description of the foot 115 and bones therein contacting the ground 120 should be understood to include instances where the foot 115 is not directly contacting the ground 120, unless the context otherwise requires.

The stance phase 105 begins with heel strike 125. Heel strike 125 is the initial contact of the foot 115 with the ground 120. The heel bone, also known as the calcaneus, is the first part of the foot 115 to make contact with the ground 120. The foot 115 then continues to come down until the forefoot of the foot 115 makes contact with the ground 120 during footflat 130. At this point, the person's weight is transferred onto the foot 115. The foot 115 then enters midstance 135 as the other foot 160 is midswing 150. During midstance 135, the foot 115 balances the weight of the body. The foot 115 then goes into pushoff 140, where the foot 115 rises while the toes 142 are still in contact with the ground 120. The gait cycle 100 then continues through the swing phase 110. The foot 115 completes acceleration 145, midswing 150, and deceleration 155 before again beginning the stance phase 105. Although not clearly visible in FIG. 1, the foot 115 rotates from its outer side 116 to its inner side 118 throughout the stance phase 105. This is the process of pronation.

Figure 2:
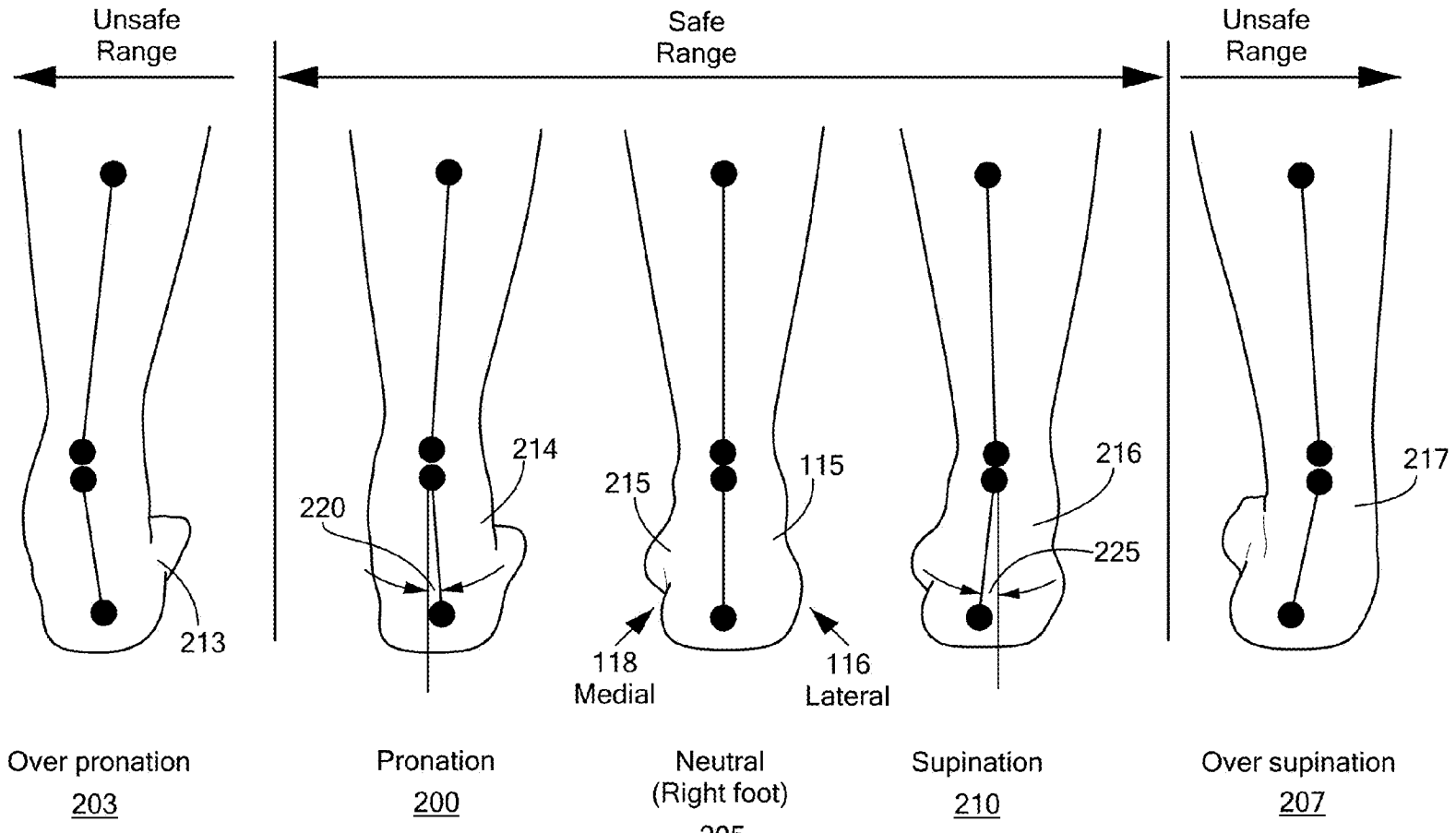
FIG. 2 schematically shows pronation and supination of a right foot.

FIG. 2 schematically shows pronation 200 and supination 210 of the right foot 115. As noted, pronation 200 is the inward roll of the foot 115 from its outer side 116 (also referred to as "lateral side 116") to its inner side 118 (also referred to as "medial side 118"). In contrast, supination 210 is the outward roll of the foot 115 from its inner side 118 to its outer side 116. Although pronation 200 and supination 210 are described generally, a person having ordinary skill in the art will understand that these are complex multiplanar movements. While pronation 200 and supination 210 refer to rotational movement, these terms can also be used to define the position of the foot 115. For example, FIG. 2 shows a pronated foot 214, a neutral foot 215, and a supinated foot 216. Supination 210 and pronation 200 are healthy and normal foot 115 functions. However, both excessive pronation 200, referred to as overpronation 203, and excessive supination 210, referred to as oversupination 207, can lead to injuries. For example, oversupination 207 commonly leads to a sprained ankle injury.

In the normal gait cycle 100, the foot 115 strikes the ground 120 at the beginning of the stance phase 105 at a supinated angle 225 of approximately 2 degrees. After initial contact, the foot 115 pronates 214. The foot 115 moves through approximately 5.5-6 degrees of pronation 200, through a neutral position 205, to a pronated angle 220 of approximately 3.5-4 degrees. The biological purpose for pronation 200 is to unlock the midfoot joints, thereby making the foot 115 mobile and adaptable to the ground/supporting surface 120. Pronation 200 also allows for better impact shock absorption in the feet 115. By the time the foot 115 is in midstance 135, the foot 115 is fully pronated 214 at an angle 220 of 3.5-4 degrees. The foot 115 begins to re-supinate 210 during and before pushoff 140 and locks the midfoot joints so that the foot 115 acts as a rigid push off surface. By converting the foot 115 from a mobile adapter to a rigid lever, the weight of the body is propelled more efficiently.

Figure 3:
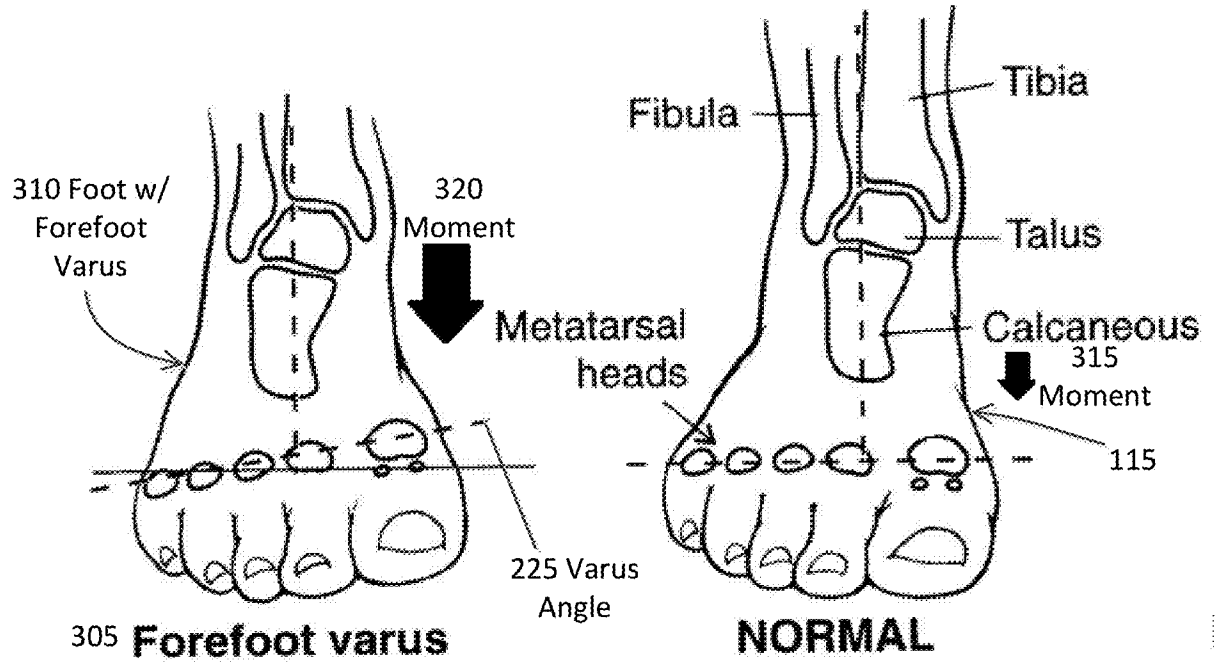
FIG. 3 schematically shows a foot having a forefoot varus abnormality next to a normal foot.

While the normal gait cycle 100 makes contact with the ground 120 in a varus posture, abnormalities of the foot 115 may cause the foot 115 to strike the ground 120 in an oversupinated position 217. This is known as a forefoot varus abnormality. FIG. 3 schematically shows a front view of a foot 310 having the forefoot varus abnormality 305 next to the normal foot 115. Compared to the normal foot 115, the foot 310 with the forefoot varus abnormality 305 strikes the ground 120 at an abnormally supinated angle 225 (also referred to as the "varus angle 225"). In normal gait 100, the varus angle 225 is small and a moment 315 produced as the foot 115 enters pronation 200 is correspondingly small. As the varus angle 225 increases, as it does with people suffering from the forefoot varus abnormality 305, the moment 320 becomes increasingly larger. The increased moment 320 causes the foot 310 to enter pronation 200 with a higher force, causing the foot 310 to compensate by overpronating 203. An overpronated stance 213 can be seen in FIG. 2.

Because the foot 310 is connected as a chain to other bones, which include the ankle to the tibia, the tibia to the knee, the knee to the femur, and the femur to the hip, the forces/moments 320 experienced by the foot 310 can be relayed up the chain. These sudden and powerful moments 320 may be unhealthy for the surrounding joint tissue in these bones and put extra strain on the surrounding muscles, which are forced to contract harder to compensate for the increased moment 320. Research has shown that people who have a large forefoot varus abnormality 305 are at a 5 times greater risk of requiring a hip replacement compared to people with normal foot 115 posture.

The forefoot varus abnormality 305 may also cause the foot 310 to go into late pronation. Late pronation, as the name suggests, is pronation 200 that is completed later in the gait cycle 100 than normally expected pronation 200. The normal function of pronation 200 is to unlock the joints of the midfoot, creating a shock absorber as the foot 115 hits the ground 120 and begins weight bearing. The foot 115 resupinates as the heel rises. Resupination locks up the joints of the foot 115 to provide a rigid lever for push-off. In some feet 115, pronation 200 continues into the phase when supination 210 should be occurring. This is referred to as late pronation.

Late pronation causes the foot 310 to experience excessive stress on the front medial side 118 during pushoff 140. Both late pronation and overpronation 203 can contribute to a number of disorders, including plantar fasciitis and hallux valgus (commonly referred to as bunions). Illustrative embodiments of the invention assist in managing overpronation 203 and late pronation caused by foot 115 structural abnormalities.

Furthermore, the forefoot varus abnormality 305 can lead to Medial Tibial Stress Syndrome, commonly referred to as shin splints. As described above, the forefoot varus abnormality 305 leads to increased moments 320 because the foot 115 hits on the lateral side and undergoes a pronation torque that becomes very large because there is a large gap between the medial side of the foot 115 and the ground 120. Normally the ground 120 itself would help slow pronation 200.

Shin splints refers to tendinitis at the origin of the posterior tibialis muscle. The posterior tibialis originates on the posterior-medial aspect of the tibial shaft, and wraps around the medial malleolus and has its insertion on the navicular 530 and cuneiforms 570. Its function is to slow pronation 200 using an eccentric contraction so the foot 115 doesn't hit the ground 120 with excessive force as it begins weight bearing, and to help pull the foot 115 out of pronation during the pushoff 140 phase.

The posterior tibialis therefore undergoes a great deal of stress because of this increased torque. If the pronation torque 320 is large enough, the foot 115 is driven into excessive pronation 200 and continues to pronate during the pushoff 140 phase. In this case, the posterior tibialis is attempting to resupinate the foot 115 at the same time it is being driven passively into pronation 200. The active-passive conflict results in stress on the posterior tibialis. Illustrative embodiments of the invention resist the pronation torque by adding a supination (restorative) torque. For example, illustrative embodiments help resupinate the foot, thereby taking the stress off the posterior tibialis.

Figure 4:
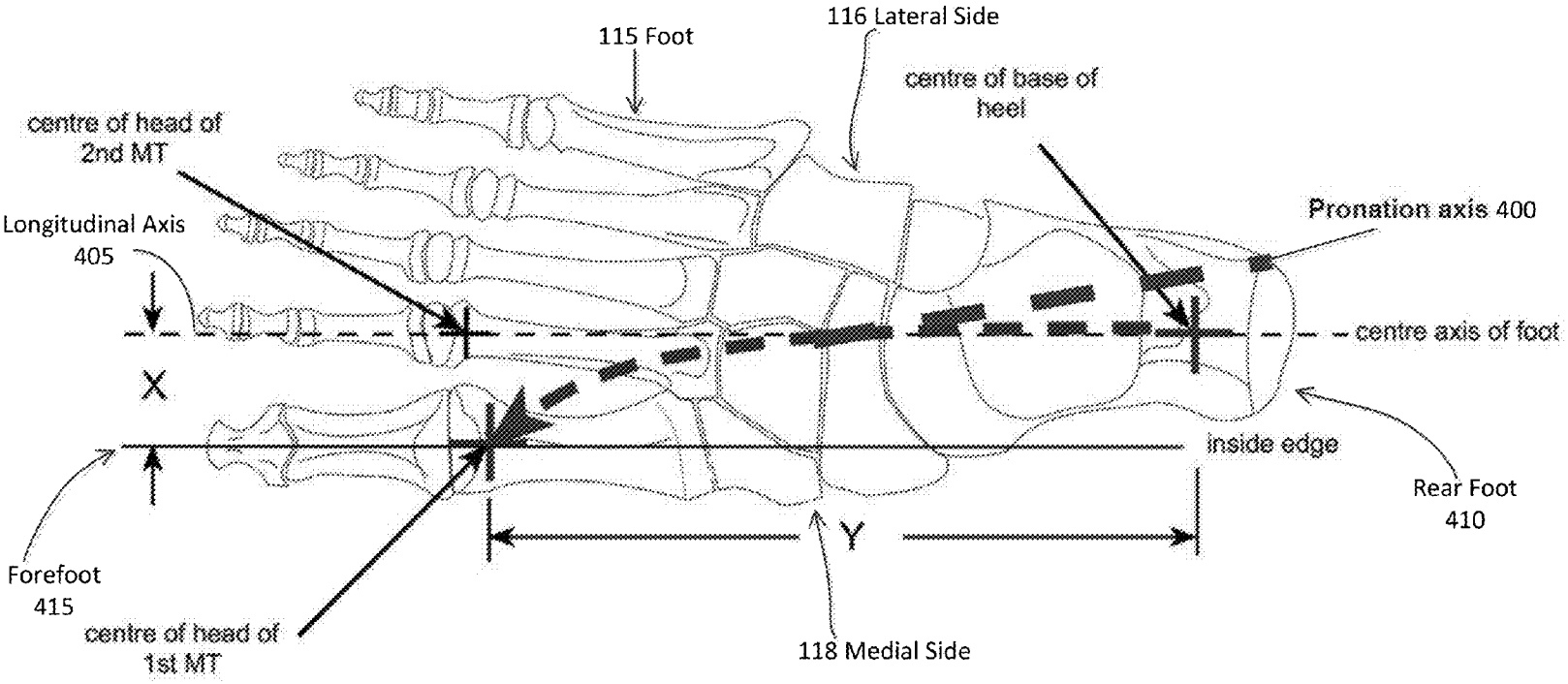
FIG. 4 schematically shows a top view of a foot skeleton and its pronation axis.

FIG. 4 schematically shows a top view of a foot 115 skeleton and the pronation axis 400. Illustrative embodiments of the invention assist the foot 115, whether healthy or not healthy (e.g., with overpronation), by providing a force about the foot pronation axis 400. As known by those skilled in the art, the pronation axis 400 is the axis about which pronation 200 and supination 210 of the foot 115 occur. The exact orientation of the pronation axis 400 depends on the morphology of the particular foot 115, and the orientation of the pronation axis 400 may change as the foot 115 pronates 200/supinates 210. However, in most normal feet 115, the pronation axis 400 falls within certain known parameters. The pronation axis 400 crosses at an angle to a longitudinal axis 405 of the foot 115. Specifically, the pronation axis 400 runs from a lateral side 116 of a rear foot 410 towards the medial side 118 of a forefoot 415. The pronation axis 400 lies at an angle to each of the axes for cardinal motions of dorsiflexion/plantarflexion, inversion/eversion, and abduction/adduction (described in FIG. 7).

Pronation 200 is a term used by those in the art to describe composite motion that has components of dorsiflexion, eversion, and abduction. As mentioned previously, the pronation axis 400 is the axis about which the foot 115 pronates 200 and supinates 210. The pronation axis 400 moves as the foot 115 moves. The foot 115 is able to pronate 200 (eversion, adduction, and plantarflexion) primarily because of the compound effect of movement around three joints: a subtalar joint, a transverse tarsal joint (also referred to as a midtarsal joint), and a tarsal metatarsal joint (also referred to as a tarsometatarsal joint). Movement of the foot 115 permitted by these three joints working together causes the foot 115 to rotate about the pronation axis 400.

Biomechanics of the foot 115 vary depending on whether the foot 115 is weight-bearing or not. A weight-bearing foot 115 is said to be in a "closed chain" configuration. Illustrative embodiments of the invention provide a force about the pronation axis 400 of the weight-bearing foot 115. Therefore, further discussion of foot 115 biomechanics may be with reference to "closed chain" motion, i.e., weight-bearing motion, unless stated otherwise.

Figure 5:
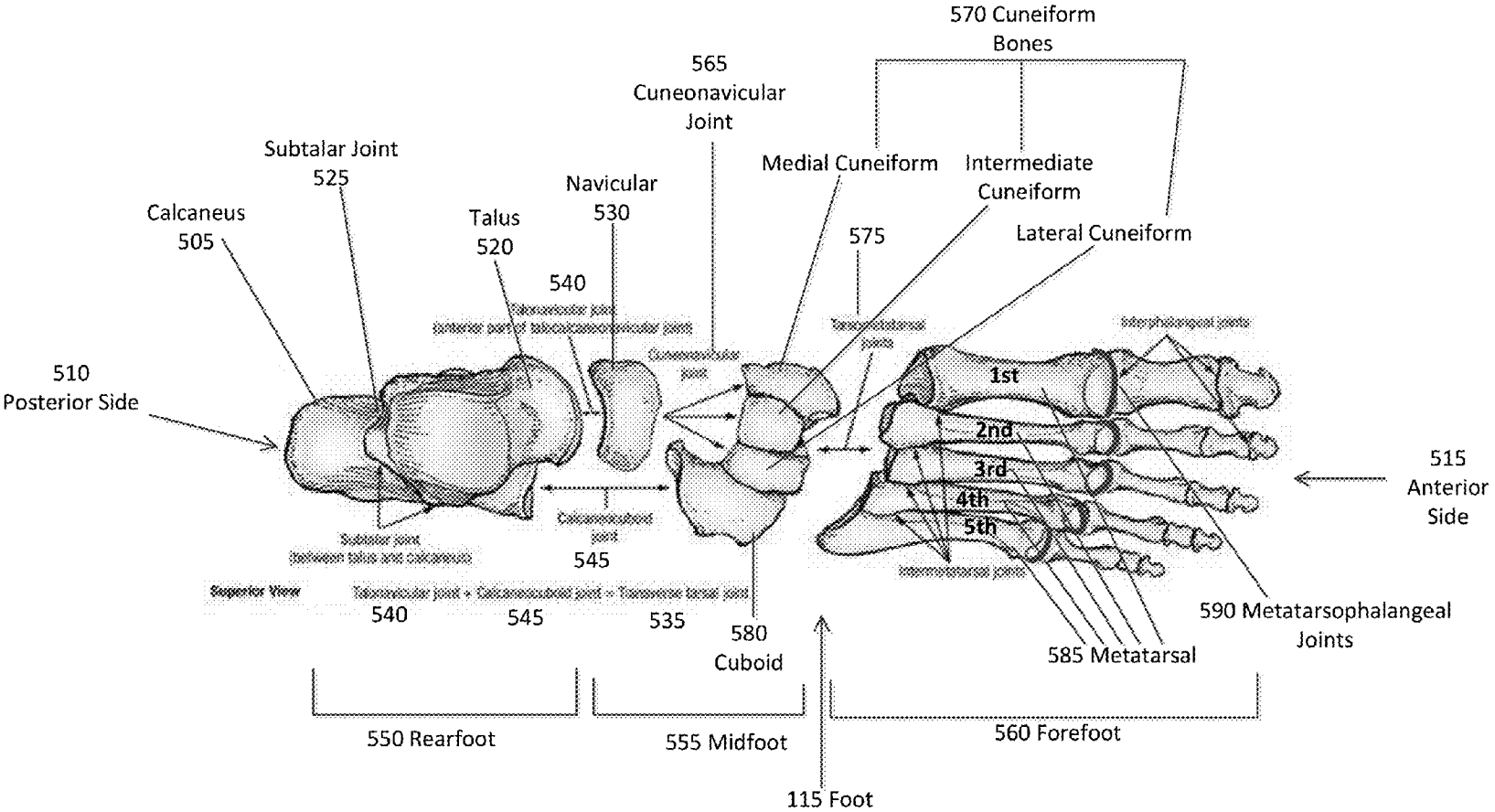
FIG. 5 schematically shows an exploded top view of a foot skeleton and foot joints.

FIG. 5 schematically shows an exploded superior view of the foot 115 skeleton. The calcaneus 505, also referred to as heel bone 505, is the most posterior 510 bone of the foot 115. Slightly anterior 515 to and above the calcaneus 505 is the talus 520, also referred to as ankle 520. The talus 520 is connected to the tibia above it (not shown here) and to the navicular 530. Rotation between the calcaneus 505 and the talus 520, about the subtalar joint 525, is communicated to an anterior side 515 of the foot 115, as well as above the foot 115, to the knee and to the hip.

The transverse tarsal joint 535 is the transitional link between the rearfoot 550 and the forefoot 560. It is a compound joint formed by the talonavicular 540 and calcaneocuboid joints 545. The transverse tarsal joint 535 adds to the supination 210/pronation 200 range of the subtalar joint 525. The transverse tarsal joint 535 also allows the forefoot 560 to remain flat on the ground 120 while the rearfoot 550 pronates 200 or supinates 210 in response to terrain or rotations of the leg.

The tarsometatarsal joints 575 are interdependent joints. During weight-bearing, the tarsometatarsal joints 575 function primarily to augment the function of the transverse tarsal joint 535. The tarsometatarsal joints 575 allow positioning of metatarsals 585 and phalanges in relation to a weight-bearing surface. The tarsometatarsal joints 575 may rotate to provide adjustment of the forefoot 560 position.

The cuneonavicular joint 565, which lies between the navicular 530 and cuneiform bones 570, is functionally part of the available tarsometatarsal joint 575 motion. As a result, the cuneiform bones 570 have essentially the same movements as each associated metatarsal 585 (i.e., first metatarsal and medial cuneiform; second metatarsal and intermediate cuneiform; and third metatarsal and lateral cuneiform).

The net effect of movement of individual bones about the aforementioned joints axes causes the foot 115 as a whole to rotate about its pronation axis 400. Illustrative embodiments of the invention provide a force about the pronation axis 400 that causes the bones of the foot 115 to move about the joints herein described. In illustrative embodiments, the bones of the foot 115 are moved in a manner similar to natural pronation 200 and supination 210.

The Subtalar Joint

Figure 6B:
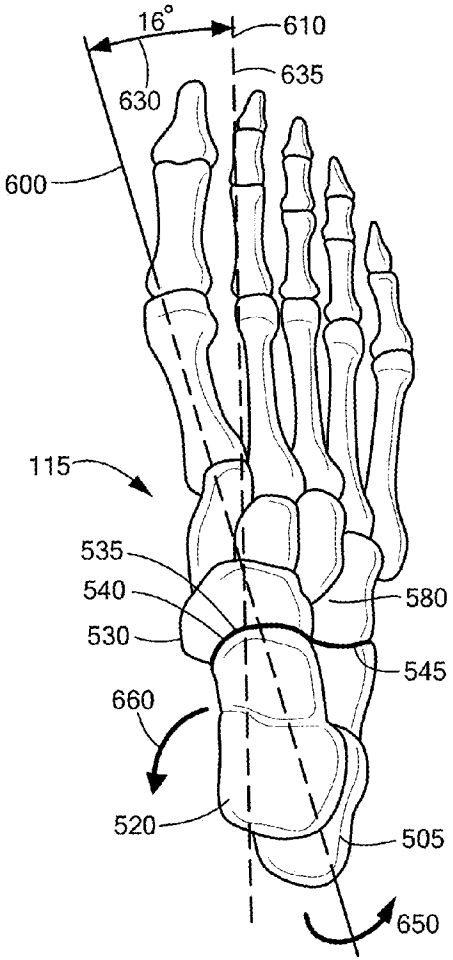
FIGS. 6A-6B schematically show a lateral and top view of the subtalar joint axis.
Figure 6A:
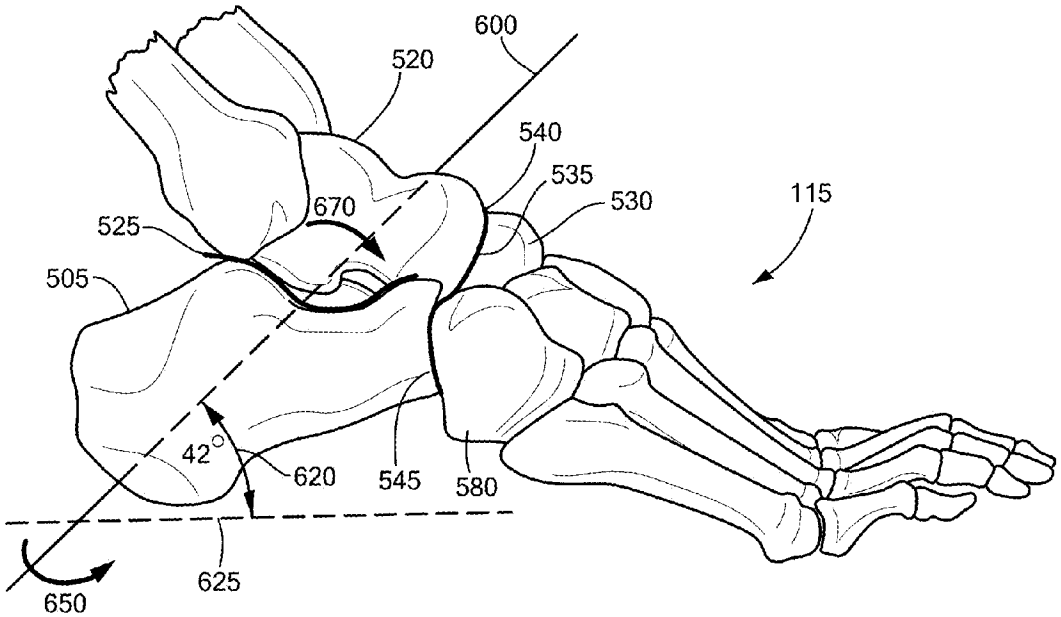

FIGS. 6A-6B show lateral and top views of the foot 115, respectively. The subtalar joint 525 allows rotational movement between the calcaneus 505 and the talus 520. The talus 520 adducts and plantar-flexes on the calcaneus 505. The calcaneus 505 everts underneath the talus 520. Thus, these bones can be said to "rotate on" one another. The movement between these bones is significant to pronation 200 because the calcaneus 505 undergoes eversion 650 and the talus 520 undergoes adduction 660 and plantarflexion 670. There is also a component of tibiofibular medial rotation tied to the talus 520 movement. The amount of movement allowed is dictated by the anatomical structure of the foot 115 and the articulations in the joint.

The subtalar joint 525 is a composite joint formed by three separate plane articulations between the talus 520 (ankle bone) and the calcaneus 505 (heel bone). Together, the three surfaces provide a triplanar movement about a single subtalar joint axis 600. In the non-weight-bearing foot 115, the subtalar joint axis 600 inclines at an angle 620 approximately of 42 degrees from a horizontal plane 625 (with a broad interindividual range of 29 to 47 degrees), and inclines at an angle medially 630 of approximately 16 degrees from a sagittal plane 635 (with a broad interindividual range of 8 to 24 degrees). A person having skill in that art would also understand that the subtalar joint axis' 600 orientation may differ in reference to a longitudinal axis 610 during weight-bearing, as well as when the foot 115 undergoes pronation 200 and supination 210.

Rotation about the subtalar joint axis 600 results in triplanar motion during pronation 200/supination 210. As the foot 115 undergoes weight-bearing pronation 200, the calcaneus 505 everts 650, and the talus 520 undergoes adduction 660 and plantarflexion 670. Eversion 650 of the calcaneus 505 means rotating the bottom of the calcaneus 505 outward (laterally) in the frontal plane. Calcaneal eversion 650 occurs substantially about the longitudinal axis 610. Talar adduction 660 means rotating the talus 520 inward towards the centerline of the body. The weight-bearing calcaneus 505 continues to contribute to eversion 650, but adduction 660 and plantarflexion 670 are accomplished by movement of the talus 520. Talar adduction 660 occurs substantially about the vertical axis. When the head of the talus 520 adducts in weight-bearing subtalar pronation 200, the body of the talus 520 must rotate medially in the transverse plane. The superimposed tibia and fibula are also brought into medial rotation.

Lastly, talar 520 plantarflexion 670 means rotating the talus 520 downwards towards the ground 120. This happens substantially about the coronal axis of the foot 115. Generally, these three combined movements cause the subtalar joint axis 600 to decrease the angle 620 from the horizontal plane 625, and to increase the angle 620 from the sagittal plane 635. Although the motions in different planes can be described separately, a person having skill in the art will understand that these motions are coupled and cannot occur independently. Instead, the triplanar motions occur simultaneously as the talus 520 and calcaneus 505 move across the subtalar joint's 525 three articulated surfaces. Together, the three surfaces provide a triplanar movement about a single joint axis.

Transverse Tarsal Joint

The transverse tarsal joint 535 (also referred to as midtarsal joint 535) is a compound joint formed by the talonavicular 540 and calcaneocuboid joints 545. The navicular 530 and cuboid 580 bones are considered largely immobile in the weight-bearing foot 115. Transverse tarsal joint 535 motion is often considered to be motion of the talus 520 and of the calcaneus 505 on the relatively fixed naviculocuboid 530/580 unit.

As a result, the transverse tarsal joint 535 has a similar function to the subtalar joint 525. In fact, the subtalar joint 525 and the transverse tarsal joint 535 are linked mechanically. During weight-bearing motion on flat ground 120, the transverse tarsal joint 535 causes the talonavicular joint 540 and the calcaneocuboid joint 545 to supinate 210 as the subtalar joint 525 supinates 210. The ground 120 reaction force on the medial forefoot causes the medial metatarsals to produce a torque that initiates (along with other mechanisms) supination 210 of the transverse tarsal joint 535. Normally, because the transverse tarsal joint 535 and the subtalar joint 525 are mechanically linked, the subtalar joint 525 also undergoes supination 210.

During pronation 200, the transverse tarsal joint 535 maintains normal weight-bearing forces on the forefoot 560 while allowing the rearfoot 550 to absorb the rotation. Because the rearfoot 550 rotates while the forefoot 560 stays stationary, effectively, the forefoot 560 has moved in a direction opposite the rearfoot 550.

The calcaneocuboid joint 545 is linked in weight-bearing to the subtalar joint 525. During supination 210/pronation 200 the inversion/eversion of the calcaneus 505 on the talus 520 causes the calcaneus 505 to move simultaneously on the relatively fixed cuboid 580 bone. This causes the calcaneus 505 to interact with the conflicting intra-articular demands of the cuboid 580, which results in a twisting motion of the calcaneus 505.

Figure 7A:
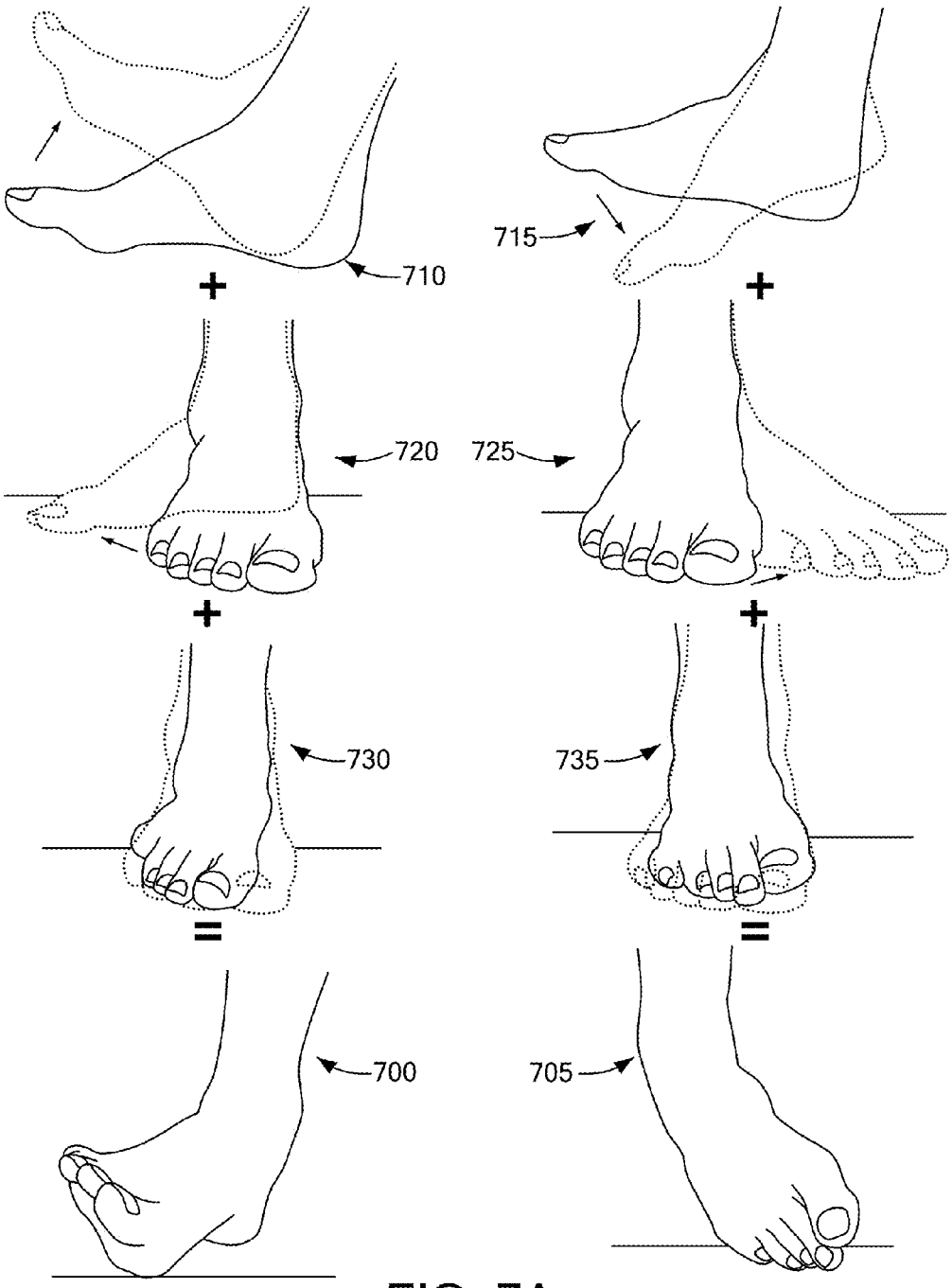
FIG. 7A schematically shows dorsiflexion/plantarflexion, abduction/adduction and eversion/inversion of a non-weight-bearing foot.
Figure 7B:
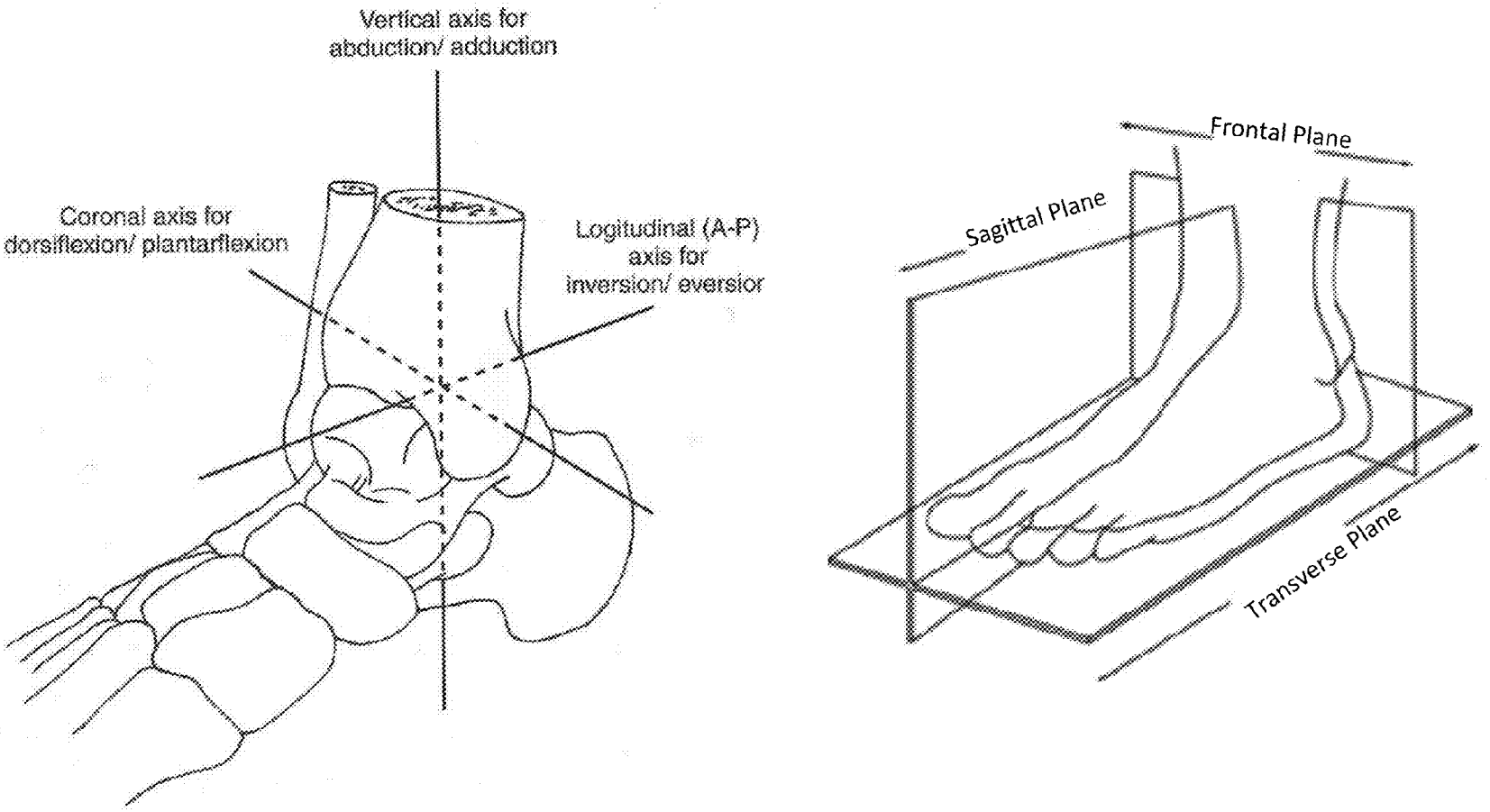
FIG. 7B schematically shows the different axes and planes involved in foot movement.

FIG. 7A schematically shows dorsiflexion 710/plantarflexion 715, abduction 720/adduction 725 and eversion 730/inversion 735 of a non-weight-bearing foot 115. A person having skill in the art will understand that pronation 700 and supination 705 are complex multi-planar movements. Both pronation 700 and supination 705 are a composite of three "cardinal" movements. The three cardinal movements for pronation 700 are dorsiflexion 710, abduction 720 and eversion 730. The three cardinal movements for supination 705 are plantarflexion 715, adduction 725 and inversion 735. Each of the respective cardinal movements is about a different axis and results in movement in a different plane. FIG. 7B schematically shows the different axes and planes involved in foot 115 movement.

Dorsiflexion 710 and plantarflexion 715 are motions that occur approximately in the sagittal plane 635 about a coronal axis. Dorsiflexion 710 decreases the angle between the leg and the dorsum of the foot 115, whereas plantarflexion 715 increases this angle.

Inversion 735 and eversion 730 occur approximately in the frontal plane about a longitudinal axis that runs through the length of the foot 115. Inversion 735 occurs when the plantar surface of the foot 115 is brought toward the midline of the body. Eversion 730 occurs when the plantar surface of the foot 115 is moved away from the midline of the body.

Abduction 720 and adduction 725 occur approximately in the transverse plane about a vertical axis. Abduction 720 occurs when the foot 115 moves away from the midline, and adduction 725 is the opposite.

Figure 8:
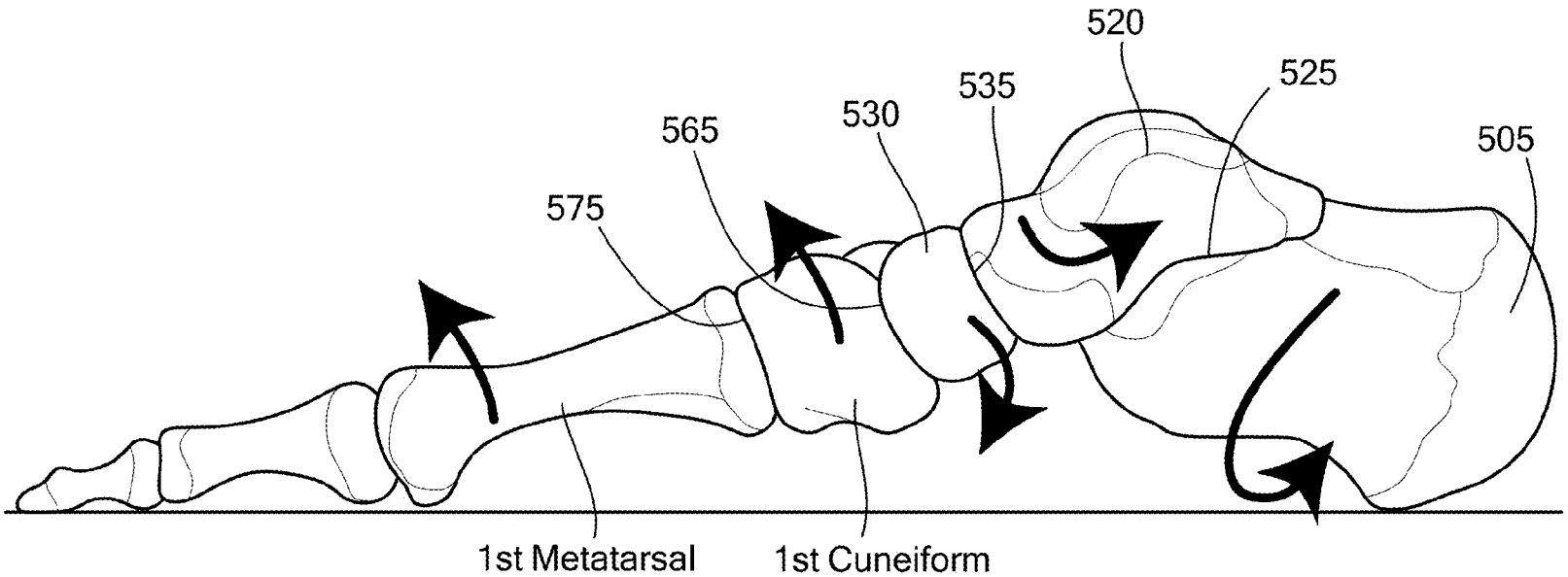
FIG. 8 schematically shows rotational movement of bones during pronation.

FIG. 8 schematically shows rotational movement of bones during pronation 200. During pronation 200, rotation of the talus 520 on the calcaneus 505, at the subtalar joint 525, is accompanied by adduction and plantarflexion of the head of the talus 520. This rotation drives the talus 520 inward and downward. The weight-bearing calcaneus 505 is able to evert, effectively rotating counter to the talus 520 about the subtalar joint 525. The navicular 530 bone is forced downwards as a result of the movement of the talus 520 and may also undergo pronation 200. As the forefoot 560 remains on the ground 120, the tarsometatarsal joints 575 also undergo a counteracting supination twist.

Figure 9A:
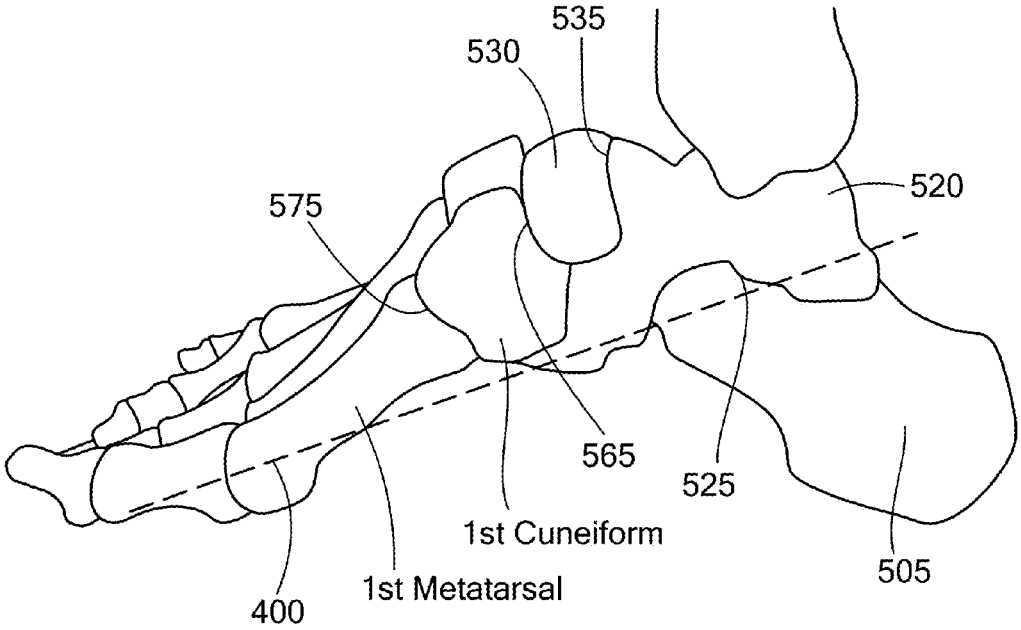
FIG. 9A shows a skeleton model of a foot prior to pronation.
Figure 9B:
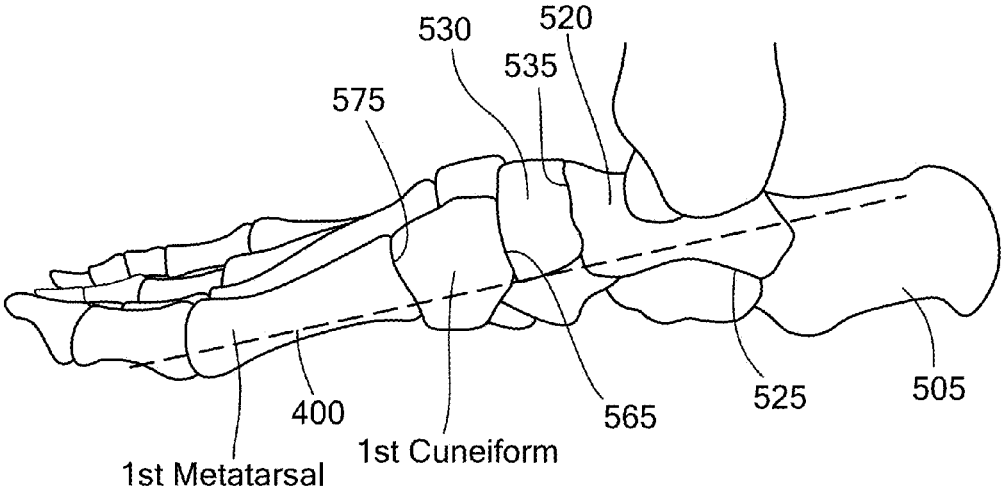
FIG. 9B shows the skeleton model of the foot in FIG. 9A in pronation.

FIG. 9A shows a skeleton model of the foot 115 prior to pronation 200. FIG. 9B shows the skeleton model of the foot 115 in pronation 200. The foot 115 is in a hyperpronated stance 203 (see FIG. 2). In FIG. 9A, the foot 115 is not weight bearing. As the foot 115 carries weight and begins to pronate 200, as shown in FIG. 9B, the calcaneus 505 everts. The talus 520 adducts on the calcaneus 505 and plantarflexes, pushing the forefoot 560 downwards. Depending upon the amount of pronation 200, the cuneiform 570 and metatarsal 585 bones may invert to counter the effect of the talus 520.

An approximation of the pronation axis 400 is shown in both figures. The pronation axis 400 is the axis about which the foot 115 rotates during pronation 200 and supination 210. Rotation of the foot 115 about the axis 400 is caused by the net effect of movement and rotation of all the individual bones about their individual axes. Because the foot 115 not only rotates during pronation 200, but also flattens and widens, the pronation axis 400 orientation is changed. The pronation axis 400 does not stay in a particular fixed orientation in relation to the foot 115, because the foot 115 is changing. As shown in the figures, the pronation axis 400 may change orientation during pronation 200/supination 210.

As described previously, the forefoot varus abnormality 305 can cause overpronation 203/late pronation of the foot 115. These conditions can lead to a host of issues. People who overpronate 203 tend to have an overly strong force moment 320 about the pronation axis 400. Illustrative embodiments of the invention assist the foot 115 by providing a force about the pronation axis 400. This force is able to dampen the force moment 320 present in overpronation 203.

Accordingly, FIGS. 1-9B generally show foot 115 anatomy as known by those in the art. The following figures now address how illustrative embodiments of the above noted orthotic improves the gait cycle 100.

Figure 10:
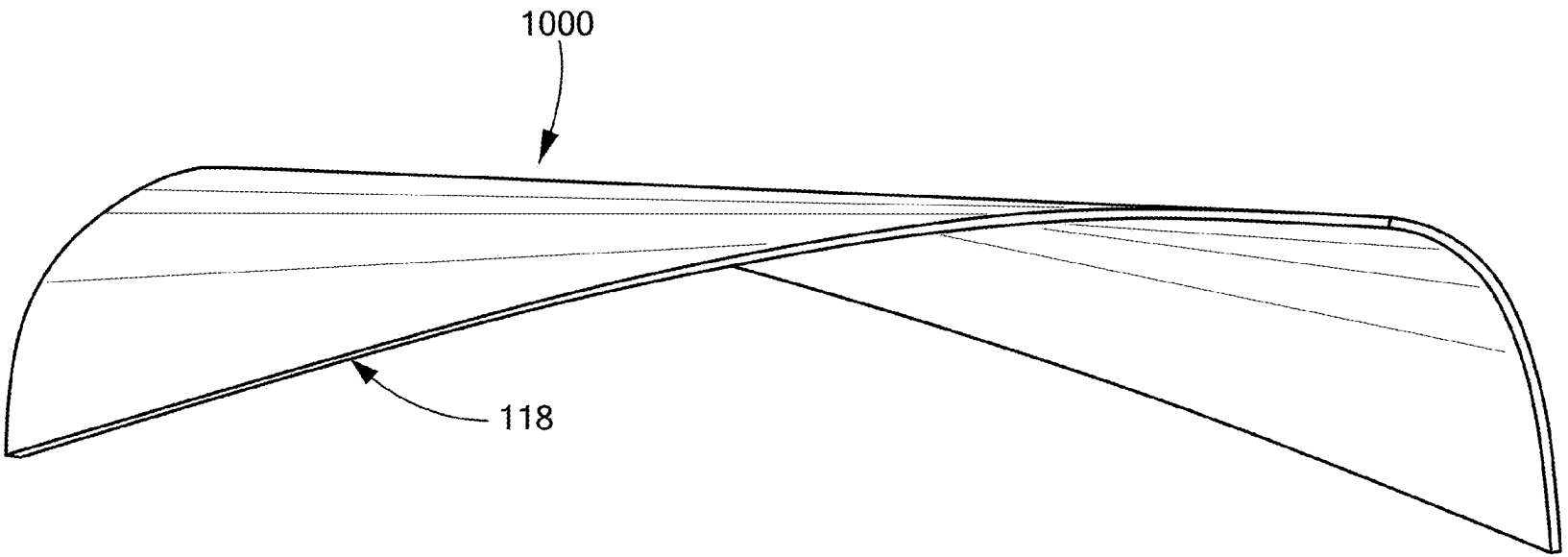
FIG. 10 shows a twisted plate for a right foot in accordance with illustrative embodiments of the invention.

To those ends, FIG. 10 shows an orthotic device/apparatus in the form of a twisted plate 1000 (for a right foot 115) configured in accordance with illustrative embodiments of the invention. The view is a perspective medial view of the twisted plate 1000. The twisted plate 1000 is in its normal/resting position. As shown, the twisted plate 1000 is formed from a piece of metal physically biased to be in a normally twisted resting position. The twisted plate 1000 may be made from a sheet of material (e.g., metal or carbon fiber) that is sufficiently thin and/or stiff to allow the plate 1000 to flex and rebound back to its original twisted position. The twisted plate 1000 may be formed as a unitary piece from a single flexible material. Alternative embodiments may form the twisted plate 1000 from a plurality of connected pieces, or in some other form (e.g., a webbing rather than one or more solid pieces).

Preferably, the twisted plate 1000 shape mimics the bottom of the human foot 115, and is configured to provide a force about the pronation axis 400 of the foot 115 during use. To that end, the twisted plate 1000 is configured to communicate with the human foot 115, either directly or indirectly. During normal human gait 100, the plate 1000 experiences forces about the pronation axis 400 of the foot 115 caused by weight-bearing, and flexes to accommodate to those forces. As discussed below, the plate 1000 produces corresponding forces in response to receipt of the noted forces caused by the foot. The twisted plate 1000 provides a countertorque to pronation 200, and thus, may be used as an orthotic device to support. The countertorque slows and controls pronation 200 and may assist the foot 115 in resupinating. This may benefit persons who experience large pronatory torques (e.g., from the forefoot varus abnormality 305) and have poor resupination capabilities (e.g., from late pronation).

Figure 11A:
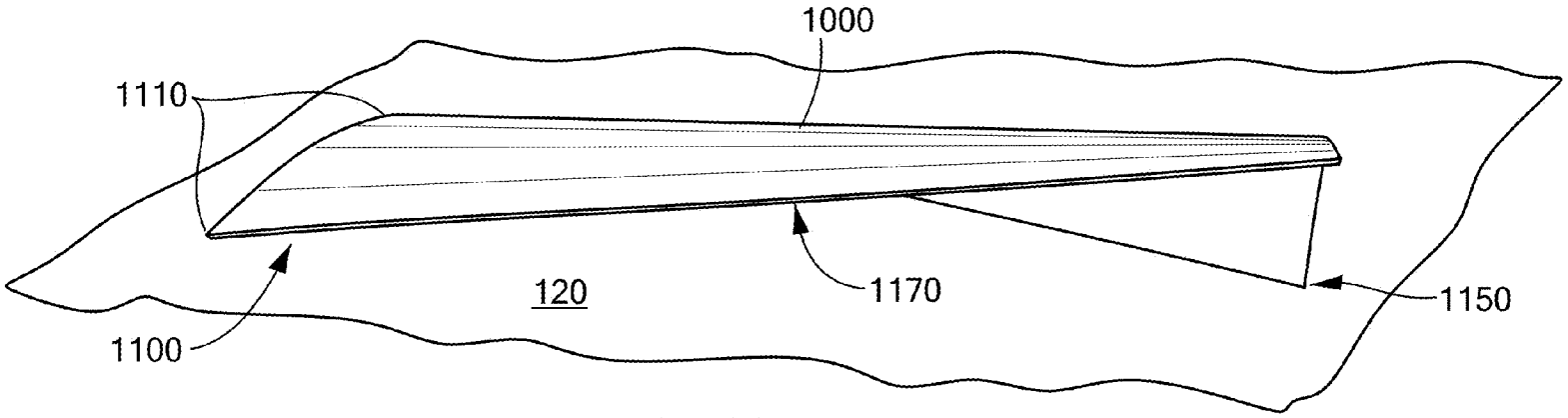
FIG. 11A shows the twisted plate in its normal, unflexed position in accordance with illustrative embodiments of the invention.
Figure 11B:
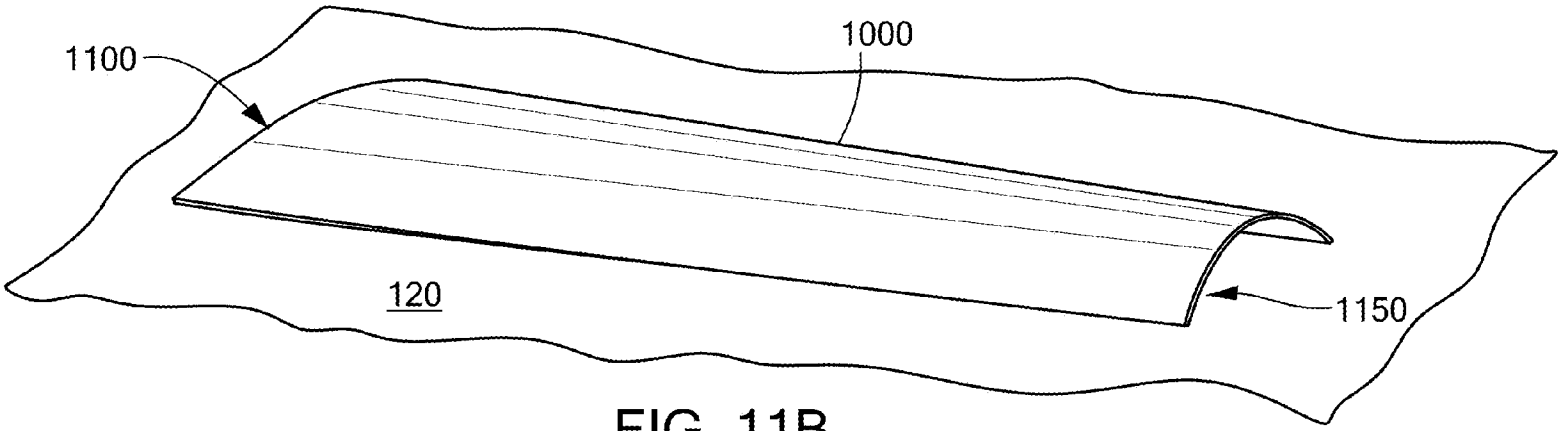
FIG. 11B shows the twisted plate of FIG. 11A in a flexed position in accordance with illustrative embodiments of the invention.

FIG. 11A shows the twisted plate 1000 in its normal/resting/biased position in accordance with illustrative embodiments of the invention. In contrast, FIG. 11B shows the twisted plate 1000 in a flexed position (i.e., when subjected to force that counteracts its bias) in accordance with illustrative embodiments of the invention. As the plate 1000 is untwisted/unwound, its natural tendency is to return to a state of equilibrium, i.e., back to its normal biased/resting position by twisting/winding back up. In illustrative embodiments, the bias of the plate 1000 to return to its normal resting position (the winded position) provides the force at least generally about/around the pronation axis 400 during pronation 200 and supination 210. As the plate 1000 flexes/unwinds, it provides a resistance (force) that may control the rate of pronation 200 (i.e., the time it takes to complete foot pronation 200). In some cases, the large pronation torque that is produced (particularly during running and/or in people with the forefoot varus abnormality 305) requires large muscle forces to control the rate, magnitude and timing of pronation 200. In some cases, the torque overcomes the ability of muscles (e.g., posterior and anterior tibialis) to control the foot 115 motion, potentially leading to excessive and late pronation, and injury. By controlling the rate of pronation 200, the plate 1000 may also reduce the forces that muscles need to produce to compensate for the increased torque, thereby resulting in metabolic savings.

In a manner similar to the human foot 115, the twisted plate 1000 may have a forefoot region 1100 and a rearfoot region 1150. The forefoot region 1100 of the twisted plate 1000 generally corresponds to the user's forefoot 560. For example, the forefoot region 1100 may contact and/or apply a force on portions of at least one of the five metatarsal bones 585, the fourteen phalanges, and/or associated soft tissue structures. In a similar manner, the rearfoot region 1150 generally corresponds to the user's rearfoot 550. For example, the rearfoot region 1150 may contact and/or apply a force on portions of at least one of the talus 520, calcaneus 505, and/or associated soft tissue structures. Furthermore, illustrative embodiments of the forefoot region 1100 and the rearfoot region 1150 may encompass portions of the user's midfoot 555.

The forefoot region 1100 has two contact points 1110 with the ground 120. During pronation 200, the bottom of the human forefoot 560 generally stays in contact with the ground 120. To compensate, the internal bones of the human forefoot 560, i.e., the metatarsal 585 and phalanges, rotate internally so that the foot 115 may pronate 200. Most of the rotation internal to the foot 115 occurs about the subtalar joint 525 and the transverse tarsal joint 535. Accordingly, in illustrative embodiments during use, the twisted plate 1000 undergoes most of its untwisting near the foot's 115 subtalar joint 525 and transverse tarsal joint 535.

Figure 12:
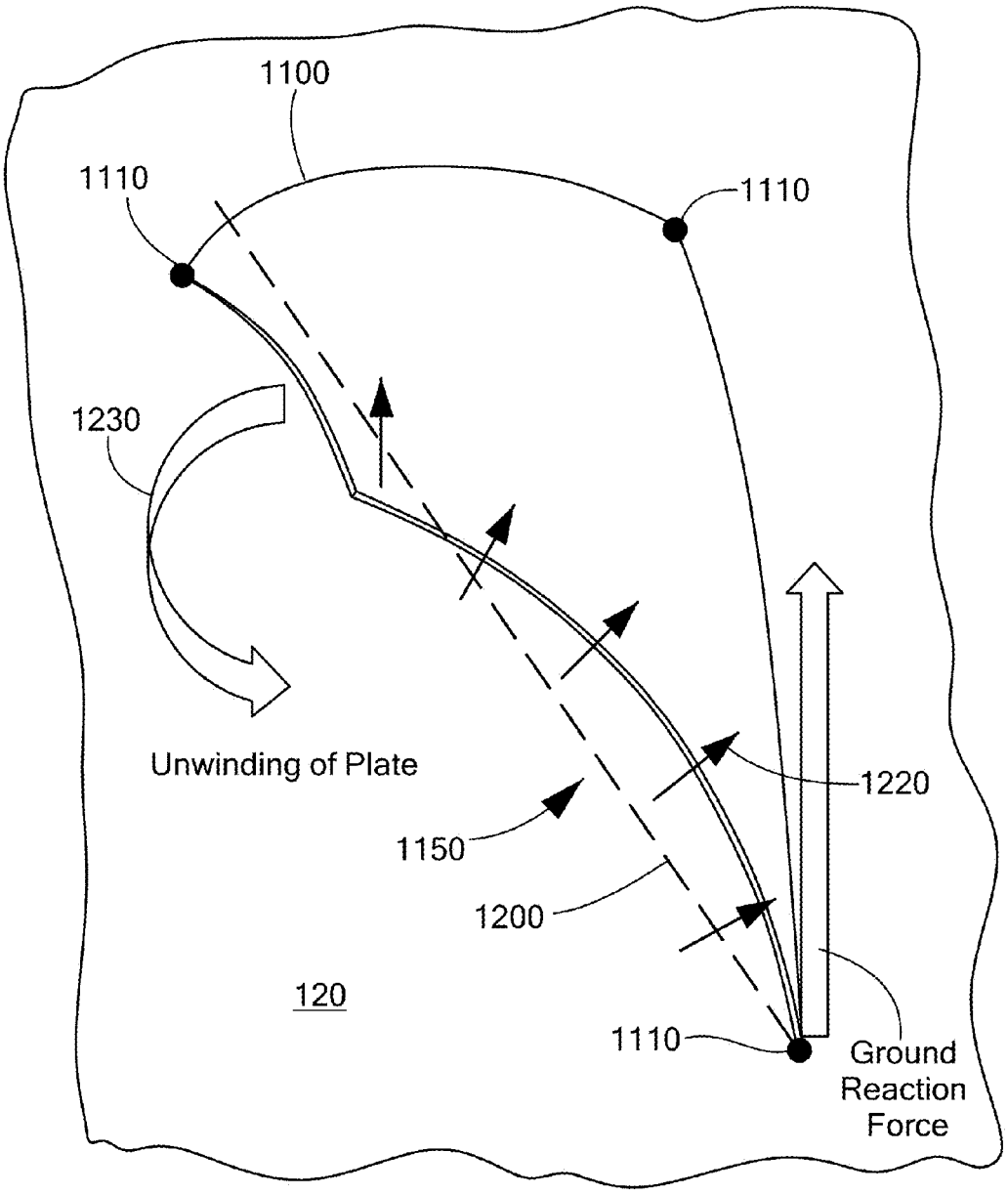
FIG. 12 shows a rear view of the twisted plate in accordance with illustrative embodiments of the invention.

FIG. 12 shows a rear view of the twisted plate 1000 in accordance with illustrative embodiments of the invention. The plate 1000 inclines from the forefoot region 1100 to the rearfoot region 1150 in a manner similar to the bones of the foot 115. In other words, illustrative embodiments of the plate 1000 follow biomimetic principles to improve or assist the gait cycle 100. In the illustrative embodiment shown, the rearfoot region 1150 has only a single contact point 1110 with the ground 120. Illustrative embodiments are not limited to this particular configuration. For example, various embodiments may have one or more contact points 1110 in the rearfoot region 1150 and/or the forefoot region 1100. Furthermore, some embodiments may have a contact region, rather than discrete contact points 1110. In the embodiment shown, the twisted plate 1000 is configured to communicate with the foot 115 from the forefoot 560 to the calcaneus 505. This embodiment does not reach the posterior of the calcaneus 505 during normal use, although the plate 1000 could be lengthened and/or a fourth ground 120 contact point 1110 could be added to facilitate such an embodiment.

As shown, the twisted plate 1000 has an axis of rotation 1200. Specifically, the twisted plate 1000 is configured so that it unwinds about an axis 1200 that is the same as, or approximates, the pronation axis 400 of the foot 115. In a manner similar to the pronation axis 400 of the foot 115, the axis of rotation 1200 of the plate 1000 geometrically translates as the foot 115 undergoes different stages of pronation 200 during the gait cycle 100. In other words, the axis of rotation 1200 does not stay in the same geometric reference to the twisted plate 1000. Instead, it may move as the twisted plate 1000 rotates, flattens and/or twists. This is similar to the pronation axis 400 moving with reference to the foot 115, as discussed previously.

During use, illustrative embodiments of the invention may be considered as providing a force 1220 about the pronation axis 400. However, it should be understood that, in some embodiments, the twisted plate 1000 provides that force 1220 about the twisted plate axis 1200, which approximates, but may not necessarily precisely match, the pronation axis 400. For example, the twisted plate axis 1200 may generally follow and/or be in alignment with the actual pronation axis 400 of the foot 115, such as by being generally parallel with the pronation axis 400, having at least a portion that is coincident with the pronation axis 400, and/or have a substantially similar shape (i.e., a shape that those skilled in the art recognize). Accordingly, illustrative embodiments of the invention provide the noted force 1220 about the noted plate axis 1200, which may substantially approximate the natural pronation axis 400 of the foot 115. Thus, the plate 1000 provides force vectors that push the bones of the foot 115 in directions that substantially mimic the natural movement of the bones of the foot 115 about their respective joints axes—using biomimetic principles.

In illustrative embodiments, the twisted plate 1000 is configured to apply the force 1220 when the foot 115 pronates 214 and when the foot 115 supinates 216. As the twisted plate 1000 begins to unwind 1230 under the force of body weight (i.e., against the natural bias of the plate 1000), it may begin to collect elastic potential energy (which is returned as kinetic energy). In some embodiments, the twisted plate 1000 functions as a leaf spring. For example, more elastic potential energy builds up as the spring unwinds 1230. As the foot 115 begins to supinate 216 and then takeoff, kinetic energy is returned. The return of kinetic energy provided by the plate 1000 as a result of the ground 120 reaction force 1220 can be used to provide enhanced motion. Although the force 1220 applied by the plate 1000 is shown generally by arrows, illustrative embodiments of the invention are not limited to the direction or magnitude of the shown force 1220 vectors. The arrows are merely used to facilitate discussion of the function of the plate 1000.

A person having skill in the art should understand that although the twisted plate 1000 may provide additional benefits to those who have foot 115 abnormalities, users with normal feet 115 (e.g., athletes) may also experience the benefits described herein from the use of the twisted plate 1000. In some embodiments, the twisted plate 1000 acts as shock absorber, stabilizes and controls the motion of the foot 115, and stores elastic energy that is returned to assist in propelling the body. A person having skill in the art should understand that a user with a normal foot 115 may experience, for example, enhanced mobility from the return of kinetic energy. Enhanced motion may mean, for example, faster acceleration and/or metabolic efficiency. During pushoff 140, the muscles of the leg expend energy, and this particular phase of gait 100 is metabolically expensive. The twisted plate 1000 may assist in pushoff 140, and thus is metabolically efficient. The twisted plate 1000 thus preferably enhances natural movement of the foot 115 and does not make the foot 115 undergo unnatural movements. When the foot 115 undergoes unnatural movements, resulting compensatory movements may be metabolically expensive. Allowing the foot 115 to move through its natural intended motions saves this metabolic expenditure. Additionally, by allowing the foot 115 to move naturally, the metabolic requirements of muscles in the foot 115, leg and hip may be reduced. These muscles are sometimes forced to contract more forcefully as a result of unnatural or overpronated 203 movements.

Figure 13A:
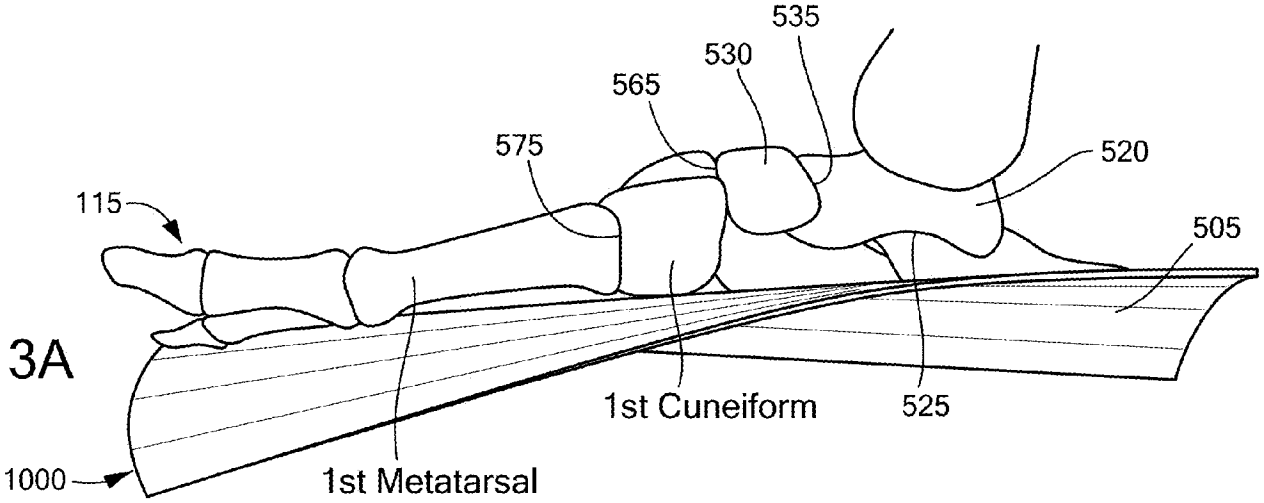
FIG. 13A shows a twisted plate in its normal resting position interacting with a skeletal model of the foot prior to pronation in accordance with illustrative embodiments of the invention.
Figure 13B:
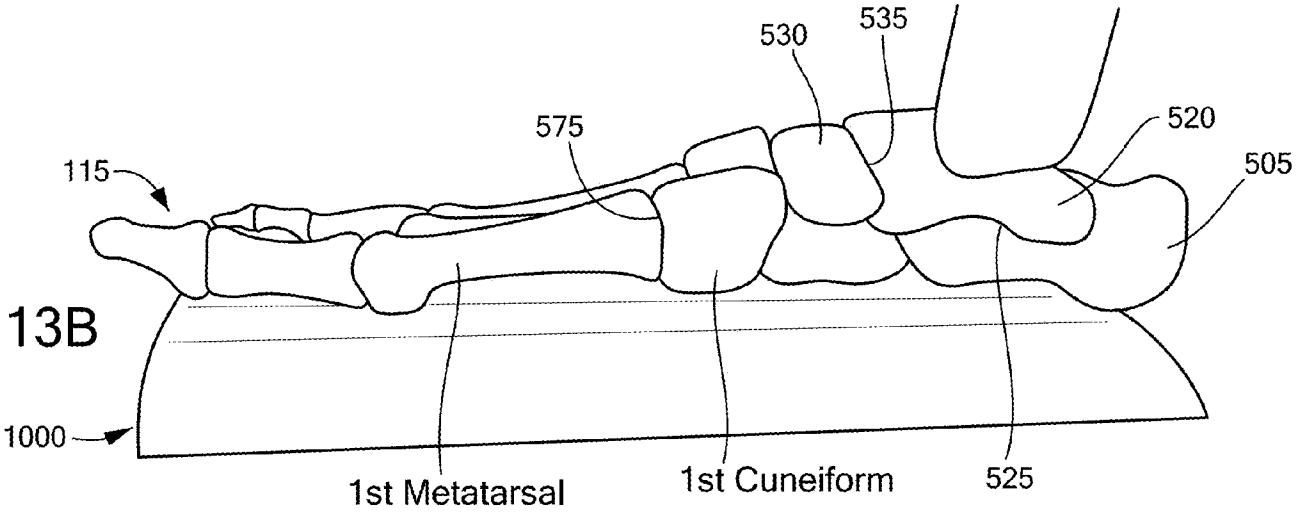
FIG. 13B shows the twisted plate in its untwisted position interacting with the skeletal model of the foot during pronation in accordance with illustrative embodiments of the invention.

FIG. 13A shows a twisted plate 1000 in its normal resting position interacting with a skeletal model of the foot 115 prior to pronation 200, in accordance with illustrative embodiments of the invention. Prior to pronation 200, i.e., during heel strike 125, the foot 115 normally is in a slightly varus posture when contact is made with the ground 120. There may or may not be some level of force applied to the plate 1000 by the foot 115 at this time, but the more significant application of force comes as the foot 115 pronates 214. FIG. 13B shows the twisted plate 1000 in its untwisted position interacting with the skeletal model of the foot 115 during pronation 200, in accordance with illustrative embodiments of the invention. As the foot 115 rotates, it applies a force, as a result of weight-bearing, about its pronation axis 400. This force is experienced by the twisted plate 1000, which has an axis of rotation 1200 that is identical, or substantially similar, to the pronation axis 400 of the foot 115.

In some embodiments, the twisted plate 1000 has features that align it with the foot 115 so that the force 1220 provided by the plate 1000 is substantially about the pronation axis 400. As the foot 115 pronates 214, the plate 1000 unwinds. As the foot 115 supinates 216, and returns to a position similar to that shown in FIG. 13A, the twisted plate 1000 winds back up. In illustrative embodiments, the winding of the plate 1000 releases the kinetic energy stored during the deformation and untwisting of the plate 1000 during pronation 200.

As the foot 115 pronates 214 the body weight applies a force on the twisted plate 1000, the twisted plate 1000 provides the force 1220 that is acting on the foot 115. Because the twisted plate's 1000 axis of rotation 1200 is configured to be substantially the same as the pronation axis 400 of the foot 115, the plate 1000 provides the force 1220 against the foot 115 directed substantially about the foot's 115 pronation axis 400. The force 1220 dampens the effect of the large moment 320 that may cause a foot 115 to overpronate 203, and it may help the foot 115 supinate 210 more quickly, thereby countering the effect of late pronation. In some embodiments, the twisted plate 1000 may prevent overpronation 203 and/or late pronation.

By directing the force 1220 about the pronation axis 400, the twisted plate 1000 not only pushes the entire foot 115 back into supination 210, it is able to do so by using the foot's 115 natural internal joint movement. Thus, the plate 1000 is biomimetic in the sense that the force 1220 is directed in such a way that the bones and joints are pressed into their natural movement patterns. Accordingly, the twisted plate 1000 enhances the natural movement of the foot 115, rather than pushing the foot 115 into unnatural movements, such as a device that would apply the force 1220 about the longitudinal axis 610 of the foot 115. The twisted plate 1000 may also allow healthy individuals to run or walk faster, or stand for longer periods of time without fatigue.

In some embodiments, because the twisted plate 1000 provides the force 1220 generally about/around the pronation axis 400 of the foot 115, the twisted plate 1000 should reduce or prevent the incidence of overpronation 203. Thus, illustrative embodiments may help prevent the formation of shin splints by relieving the amount of stress pressed on the posterior tibialis muscle, among others. Furthermore, illustrative embodiments of the invention may cause the foot 115 to complete supination 210 more quickly. This may also reduce or prevent the incidence of late pronation. Illustrative embodiments of the invention may prevent the occurrence of bunions, plantar fasciitis, and a host of other foot conditions caused by foot 115 abnormalities. Illustrative embodiments of the invention may also reduce the occurrence of injuries to the knee, hip, and lower-back, as described above with reference to FIG. 3.

Figure 14:
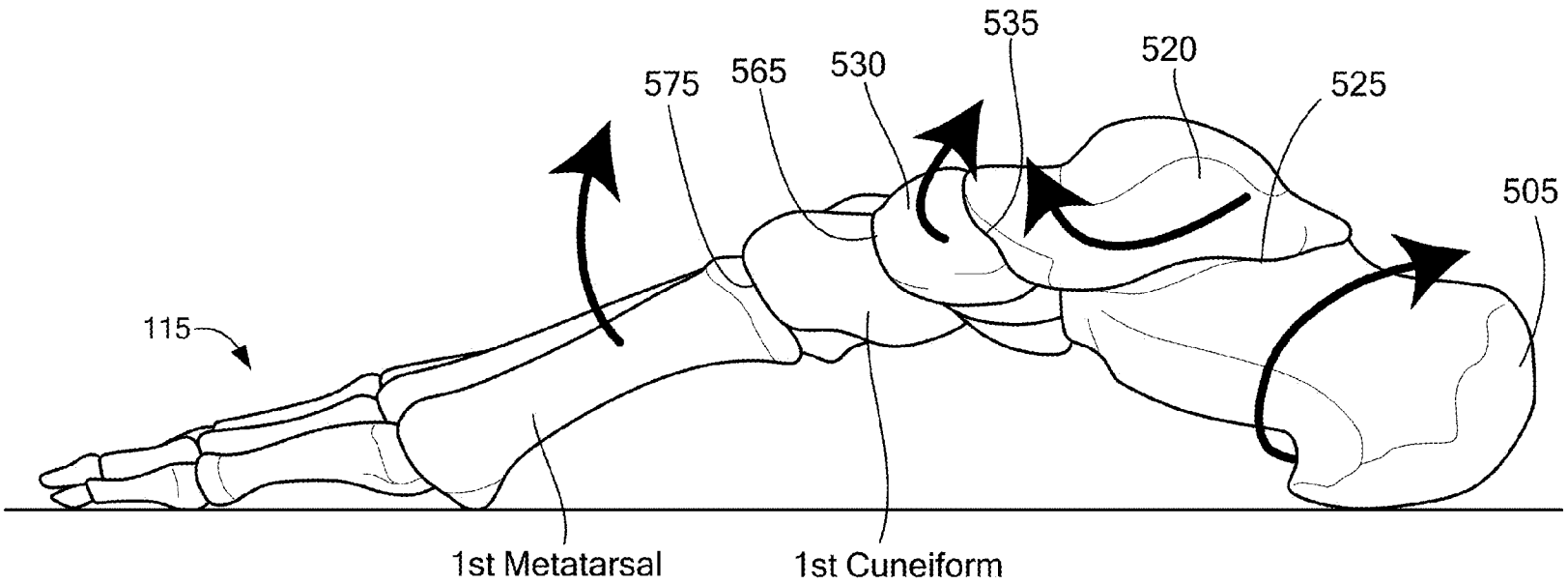
FIG. 14 shows the effect the twisted plate has on the internal structures of the foot in accordance with illustrative embodiments of the invention.

FIG. 14 shows the expected effect of the twisted plate 1000 on the internal structures of the foot 115 in accordance with illustrative embodiments of the invention. As discussed above, the twisted plate 1000 may apply the force 1220 about the pronation axis 400, or an axis 1200 that approximates the pronation axis 400. The force 1220 from the twisted plate 1000 pushes the bones of the foot 115 back towards their natural configuration when the foot 115 is in the supinated position 216. The force 1220 provided by the twisted plate 1000 is directed substantially about the pronation axis 400 of the foot 115. In some embodiments, the force 1220 provided by the twisted plate 1000 pushes the calcaneus 505 back into inversion. The force 1220 provided by the twisted plate 1000 may push the talus 520 back into abduction. The force 1220 provided by the twisted plate 1000 may push the talus 520 back into dorsiflexion. The force provided by the twisted plate 1000 may push the navicular 530 back into inversion. The force 1220 provided by the twisted plate 1000 may push the medial, intermediate, and lateral cuneiforms 570 into inversion. The force 1220 provided by the twisted plate 1000 may push the metatarsals 585 into inversion.

In some embodiments, the twisted plate 1000 may provide the force 1220 that pushes any combination of, including all, the aforementioned bones back into the aforementioned positions. In illustrative embodiments, applying the force 1220 about an axis 1200 that approximates the pronation axis 400 pushes the bones of the foot 115 as described above. A person having skill in the art will understand that pushing certain bones into abduction, adduction, inversion, eversion, plantarflexion, and dorsiflexion does not necessarily imply the same type of movement in the non-weight-bearing foot as shown in FIG. 7A.

The force 1220 preferably causes some bones to rotate about the subtalar joint 525 axis 600. The force 1220 provided may cause bones to rotate about the transverse tarsal joint 535 axis. In some embodiments, the force 1220 provided causes bones to rotate about the tarsometatarsal joint 575 axis. The force 1220 provided may cause bones to rotate about the talonavicular joint 540 axis. The force 1220 provided may cause bones to rotate about the calcaneocuboid joint 545 axis. The force 1220 provided may cause bones to rotate about the cuneonavicular joint 565 axis. In some embodiments, the force 1220 provided may cause bones to rotate about any combination of the aforementioned joints. In some embodiments, the force 1220 provided causes movement of the aforementioned joints in any aforementioned combination. In some embodiments, the force 1220 provided causes rotation of bones and movement of joints in any of the aforementioned combinations. A person of skill in the art will understand the joint movements that are coupled to the movements of the bones.

It should be understood that illustrative embodiments of the invention provide various amounts of force 1220 based on their structural and material design. Although discussion of illustrative embodiments are described as pushing certain bones and/or joints "back into" inversion, eversion, plantarflexion, dorsiflexion, abduction and/or adduction, it is not necessary that the bone and/or joint be fully or actually moved into that anatomical position. Illustrative embodiments of the twisted plate 1000 may only provide the force 1220 that pushes the bones and/or joints towards inversion, eversion, plantarflexion, dorsiflexion, abduction and adduction, while not being sufficiently strong to cause the bones and/or joints to undergo that movement. For example, when the calcaneus 505 is being pushed into inversion by the plate 1000, illustrative embodiments of the invention simply provides the force 1220 directed to pushing the calcaneus 505 back into inversion, but do not necessarily cause the calcaneus 505 to go into inversion. The calcaneus 505 may be everted up to the entire time the twisted plate 1000 is trying to push the bone back into inversion, while it may still be said that the plate 1000 was pushing the calcaneus 505 back into inversion.

A person having ordinary skill in the art should understand that by providing the force 1220 about the pronation axis 400, that the natural movement of the foot 115 is enhanced. A person having skill in the art will also understand that in illustrative embodiments, the force 1220 is directed substantially normal to the surface of the twisted plate 1000 about the pronation axis 400. While some embodiments of the invention provide a force 1220 that pushes the foot 115 back towards supination 210, the bones and internal joints are also pushed back towards supination 210. As a result, some embodiments provide composite motion about the subtalar joint axis 600, the midtarsal joint 535 axis, and the tarsometatarsal joint 575 axis.

In some embodiments, the force 1220 provided by the twisted plate 1000 is a constant magnitude. In other embodiments, the force 1220 provided by the twisted plate 1000 is non-linear. For example, the twisted plate 1000 may provide a progressively stronger force 1220 the more it is untwisted (e.g., as a response to material deformation). This may be in a manner similar to the response of healthy soft tissue (e.g., fascia) and/or a "hard" spring. In other words, the twisted plate 1000 may have increased stiffness as it is untwisted, or a stronger resistance to deformation. Specifically, as the foot 115 pronates 214, the force 1220 may become increasingly stronger.

The twisted plate 1000 having a non-linear force 1220 may be suitable for a multitude of user weights, and a multitude of activity levels. For example, the non-linear twisted plate 1000 can be used by a child (i.e., a lighter-weight user) without being overly stiff. In other words, the weight of the child is sufficient to untwist the plate 1000 and provide some level of kinetic energy return via force 1220. The same non-linear plate 1000 may be used by an adult (i.e., a heavier-weight user) because the plate 1000 provides a stronger force 1220 as the plate 1000 is further deformed under the increased weight of the adult. For example, the force 1220 may have an exponential correlation to deformation (i.e., untwisting).

In a similar manner, walking is expected to deform the plate 1000 less than running does, because running provides a heavier load upon the plate 1000. A non-linear plate 1000 can accommodate lighter loads experienced by walking, as well as higher-loads experienced while running. A user who is walking likely will experience a lesser force 1220 than a user who is running, assuming all other variables are equal. Thus, the amount of force 1220 the plate 1000 provides may be suitable to the use. The plate 1000 could be formed from, for example, carbon fiber with a non-linear stiffness. In some embodiments, the plate 1000 may have a non-linear stiffness and also include a hard stop, at which point the plate 1000 no longer deforms.

Alternatively, the twisted plate 1000 may provide the strongest force 1220 as it is initially untwisted and may provide force 1220 with less magnitude the more it unwinds. It should be understood that because the pronation axis 400 moves as the plate 1000 is rotating, the force vector may not be consistent. As discussed, the magnitude of the force 1220 may be variable during the untwisting of the plate 1000. Additionally, the direction of the force 1220 vector may be variable during the untwisting of the plate 1000. For example, in some embodiments, at any given moment the direction of the force 1220 vector applied by the twisted plate 1000 may be in a direction that is opposite the direction of force applied by the foot 115 about the pronation axis 400.

In some embodiments, the force 1220 applied by the twisted plate 1000 against the foot 115 varies along the length of the twisted plate 1000. This variance may be in addition, or alternatively, to the variance of force 1220 provided during the twisting/untwisting of the plate 1000. For example, the twisted plate 1000 may provide relatively small force 1220 about the pronation axis 400 at the forefoot region 1100 of the plate 1000, but may provide a relatively stronger force 1220 about the pronation axis 400 towards a midfoot region 1170. Additionally, or alternatively, the force 1220 applied by the twisted plate 1000 may vary along the width of the twisted plate 1000. For example, for any given length, the plate 1000 may apply more force 1220 against the near the medial side of the plate 1000, and less force 1220 along the lateral side of the plate 1000. In illustrative embodiments, stiffness of the plate 1000 may increase towards the front of the foot 115. This may provide extra force 1220 by the toes 142, which would assist with rebound during pushoff 140. Persons having ordinary skill in the art can adjust the parameters of the plate 1000 (shape, thickness, materials) to affect the amount of force 1220 produced by the plate 1000. For example, a person of skill knows how to adjust the stiffness of the twisted plate 1000 to provide the desired amount of force 1220 based on the weight of the user.

Figure 15A:
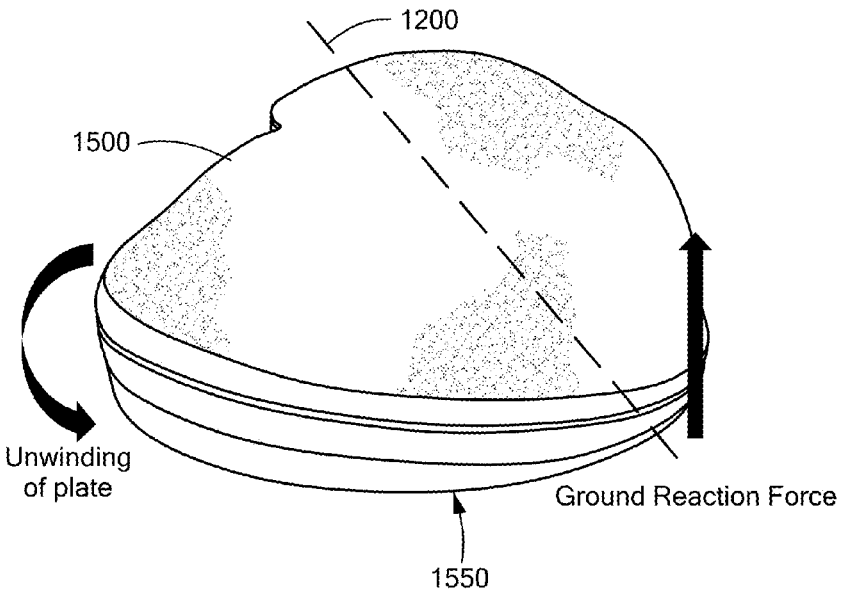
FIGS. 15A-B show a twisted plate inserted in an insole for a right shoe in accordance with illustrative embodiments of the invention.
Figure 15B:
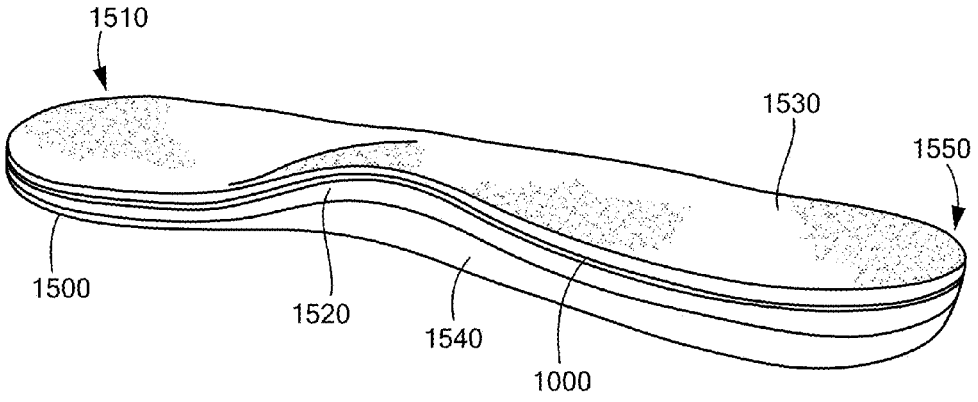
Figure 15C:
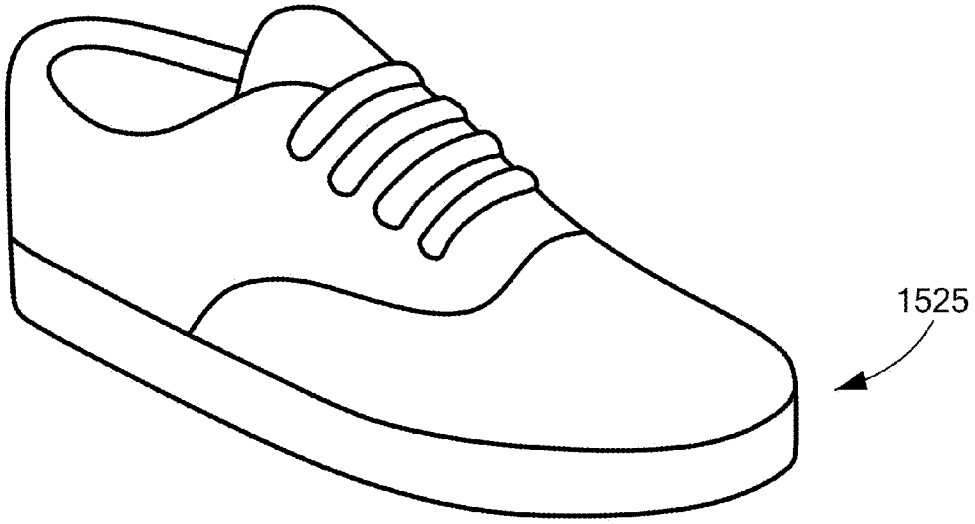
FIG. 15C schematically shows a shoe for a right foot in accordance with illustrative embodiments of the invention.

It is not necessary that illustrative embodiments of the invention directly contact the foot 115. Indeed, in preferred illustrative embodiments, the twisted plate 1000 is inserted in footwear, such as a shoe, or embedded within an insole 1500 of a shoe. FIGS. 15A-B show the twisted plate 1000 inserted in the insole 1500 for a right shoe (FIG. 15C), in accordance with illustrative embodiments of the invention. The footwear may be, for example, sneakers, cleats, loafers, boots, or formal shoes. The twisted pate 1000 may be embedded between or within low durometer sponge-like material 1520. In some embodiments, insoles 1500 are at least partly formed from low durometer material 1520 for comfort because low durometer material 1520 is less likely to interfere with the normal functioning of the twisted plate 1000. In some embodiments, the material on top of the twisted plate 1000 may be formed from a harder foam 1530, such as the type commonly used in sneakers. Some embodiments of the insole 1500 may have a third material 1540 at the bottom, which may be harder than the lower durometer material 1520.

As shown in the figures, the insole 1500 material may be molded to the shape of the twisted plate 1000. The twisted plate 1000 has its axis of rotation 1200, and the insole 1500 can be molded to work with and take on the shape of the twisted plate 1000. To that end, the insole 1500 may be thinner, and flat, towards a forefoot region 1510 of the insole 1500. A flat front insole 1500 allows the forefoot of the foot 115 to rest in a neutral position on flat ground 120. Furthermore, the rearfoot region 1150 of the plate 1000 may be angled. The material may become progressively thicker towards the midfoot region 1170 to match the shape of the twisted plate 1000. The twisted plate 1000 may also extend all the way to end of the rearfoot 1150 plate. The insole 1500 may be sized to sit within a shoe so that when a person wears the shoe, the axis of rotation 1200 of the twisted plate 1000 and the pronation axis 400 of the foot 115 substantially align. To that end, the insole 1500 may be shaped to substantially translate forces (direction and/or magnitude) about the pronation axis 400 to about the axis of rotation 1200, and vice versa.

It should be understood that the terms rearfoot region 1150, midfoot region 1170, and forefoot region 1100 are directional references. These terms should not be interpreted as limiting some embodiments of the invention to embodiments that contact or extend all the way to the rearfoot 550 and/or forefoot 560 of the foot 115. While some embodiments may be so limited, some embodiments may not.

Furthermore, various illustrative embodiments may configure the plate 1000 in a different normal resting state from the normally twisted resting state shown. For example, some embodiments may provide a twisted plate 1000 that is configured to provide the force 1220 as soon as the foot 115 begins pronating 200. Some other embodiments may have a twisted plate 1000 configured to be in a resting state that provides the force 1220 when the foot 115 is half-way through pronation 200. Various embodiments of the twisted plate 1000 may initiate application of the force 1220 as a function of foot 115 position in the pronation 200/supination 210 cycle. Some embodiments of the invention may modulate the level of force 1220 applied to the foot 115. For example, some embodiments may provide a twisted plate 1000 that may function as a leaf spring and may apply the force 1220 as soon as pronation 200 begins. These embodiments could provide a stronger force 1220 than some embodiments that are configured to provide the force 1220 half way through the pronation 200 cycle. This is because spring force 1220 may vary as a function of stretching, and a leaf spring that is initiated at the beginning of the pronation 200 cycle is stretched further than a spring that is initiated half-way through pronation 200.

It should be understood from the above discussion that illustrative embodiments of the twisted plate 1000 are not necessarily completely twisted or untwisted during use. A person having ordinary skill will also understand that illustrative embodiments of the twisted plated 1000 generally unwind as the foot 115 pronates 214 and wind as the foot 115 supinates 216. Because the twisted plate 1000 is configured to return to a twisted configuration after flexing, energy is stored by the plate 1000. The plate 1000 releases that energy as it returns to its normal twisted configuration.

In some embodiments, the elastic potential energy stored by the plate 1000 allows it to function as a spring, which releases kinetic energy as the foot 115 pushes off the ground 120. Accordingly, the twisted plate 1000 may act as a performance enhancer (e.g., improve running performance) in addition to improving gait 100. In applications where performance enhancement is the ultimate objective, the twisted plate 1000 may be configured slightly differently. For example, the twisted plate 1000 may be configured to provide a predetermined amount of springiness throughout the gait cycle 100. However, some embodiments may provide more force than desired for a runner, causing the runner to oversupinate 207. Oversupination 207 commonly leads to sprained ankles. By adjusting the point in the foot 115 pronation-cycle during which the twisted plate 1000 begins applying force 1220, and the structural and material properties of the twisted plate 1000, desired springiness can be achieved. Persons having skill in the art would know how to modulate these parameters during manufacturing to prevent overspringiness, if desired.

Figure 16:
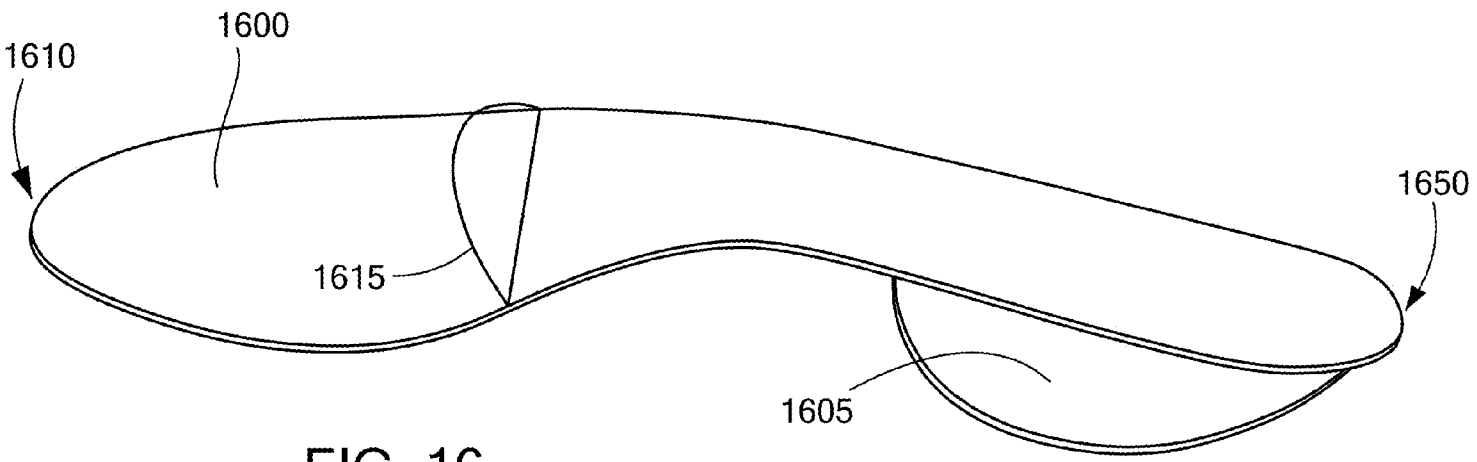
FIG. 16 shows a cantilevered twisted plate in accordance with illustrative embodiments of the invention.

The twisted plate 1000 may take on a variety of different shapes, such as a twisted rectangle or that approximating the outline of a person's foot (e.g., see FIG. 16). Illustrative embodiments may take on another shape that provides rotation about the pronation axis 400. As discussed above, the twisted plate's 1000 axis of rotation 1200 is the same as, or substantially the same as (also referred to as "imitating"), the pronation axis 400 of the foot 115. To accomplish this accurately, illustrative embodiments of the invention scan and/or measure the foot 115 of a person, and may use a computer program having code to analyze the data and customize the twisted plate 1000 for the foot 115. The foot 115 may be a human foot 115, but some embodiments are not limited to human feet 115. Illustrative embodiments are intended to support any animal or robotic foot 115, prosthetic, and hard or soft exoskeletons having a pronation axis 400.

In some embodiments, the twisted plate 1000 axis 1200 may function as the pronation axis 400 (e.g., in robots or exoskeletons that do not have a pronation axis 400). Illustrative embodiments are intended to support the construction of robotic feet 115, foot prostheses, and hard or soft exoskeletal feet 115 by providing a pronation axis. The incorporation of the twisted plate 1000 into the artificial foot 115 would endow the foot 115 with similar pronation-supination properties as the human foot 115. Twisted plate technology could similarly be used for individuals with poor foot 115 function. This could include, but is not limited to, people with "drop foot" or poor foot strength. For example, stroke, traumatic brain injury, cerebral palsy patients, and/or elderly persons.

As discussed above, it is not necessary that the twisted plate 1000 be that of a twisted rectangle or parallelogram. Indeed, some sides of the twisted plate 1000 may be longer than others. For example, the forefoot region 1100 and the rearfoot region 1150 are shown generally as having the same dimensions (FIG. 12). In some embodiments, however, the forefoot region 1100 may be differently dimensioned from the rearfoot region 1150. While the forefoot region 1100 is generally symmetric with the ground 120, some embodiments may have increased dimensions along the medial forefoot region 1100. The increased dimensions of the plate 1000 may cause the forefoot region 1100 to become slightly inverted. An inverted forefoot region 1100 may increase user comfort. The inverted forefoot design may allow the forefoot 565 to assist in the unwinding of the plate 1000 and/or to experience force 1220 from the plate 1000 at the same time that as the rest of the foot 115.

Illustrative embodiments of the invention can be incorporated inside fitted shoe 1525 sizes (e.g., U.S., European, Japanese, etc.). This includes men's, women's, children's, wide and narrow shoe 1525 sizes. A person having skill in the art knows how to size the twisted plate 1000 based on the size of the shoe 1525 and/or other variables (e.g., user's weight). The twisted plate 1000 may be customized to the foot 115 as described previously, or the twisted plate 1000 may come manufactured and sold in a set of standard sizes that complement different shoe 1525 sizes. For example, twisted plates 1000 may be sold as a set with various sets of plates 1000 depending on, for example, expected user weight (e.g., heavier-weight people, lighter-weight people), use (sprinters, long-distance runners, casual walking), or combinations thereof. The orientation of the twisted plate 1000 to the foot 115 is chosen so that the rotation axis 1200 of the twisted plate 1000 closely matches the pronation axis 400 of the foot 115. Illustrative embodiments of the invention may have features that assist in maintaining the orientation of the twisted plate 1000 within the shoe 1525.

For example, FIG. 16 shows a cantilevered twisted plate 1600 in accordance with illustrative embodiments of the invention. The cantilevered twisted plate 1600 has a forefoot portion 1610 and a rearfoot portion 1650. Towards the rearfoot portion 1650, the cantilevered twisted plate 1600 has an optional cantilevered portion 1605 (i.e., some embodiments do not have this cantilevered portion 1605). The cantilevered portion 1605 may anchor to the shoe 1525, minimizing the movement of the cantilevered twisted plate 1600 within the shoe 1525 when forces 1200 are applied to the shoe 1525. When the foot 115 pronates 214 on the cantilevered twisted plate 1600, it is expected that direction of some of the forces 1220 will not be perfectly downward. These forces 1220 could cause the cantilevered twisted plate 1600 to slide and or move about within the shoe 1525. Illustrative embodiments may have cantilevered portions 1605 to ensure the proper orientation of the cantilevered twisted plate 1600 within the shoe 1525. This, in turn, will help ensure the proper orientation of the foot 115 to the cantilevered twisted plate 1600 in the shoe 1525. Illustrative embodiments may have cantilevered portions 1605 to enhance fit and comfort. Additionally, to enhance comfort, any of the discussed embodiments of the plate 1000 may have a transverse arch portion 1615 and/or lateral longitudinal arch portion contoured generally to the shape of the transverse and lateral longitudinal arches of the foot 115, respectively.

Figure 17:
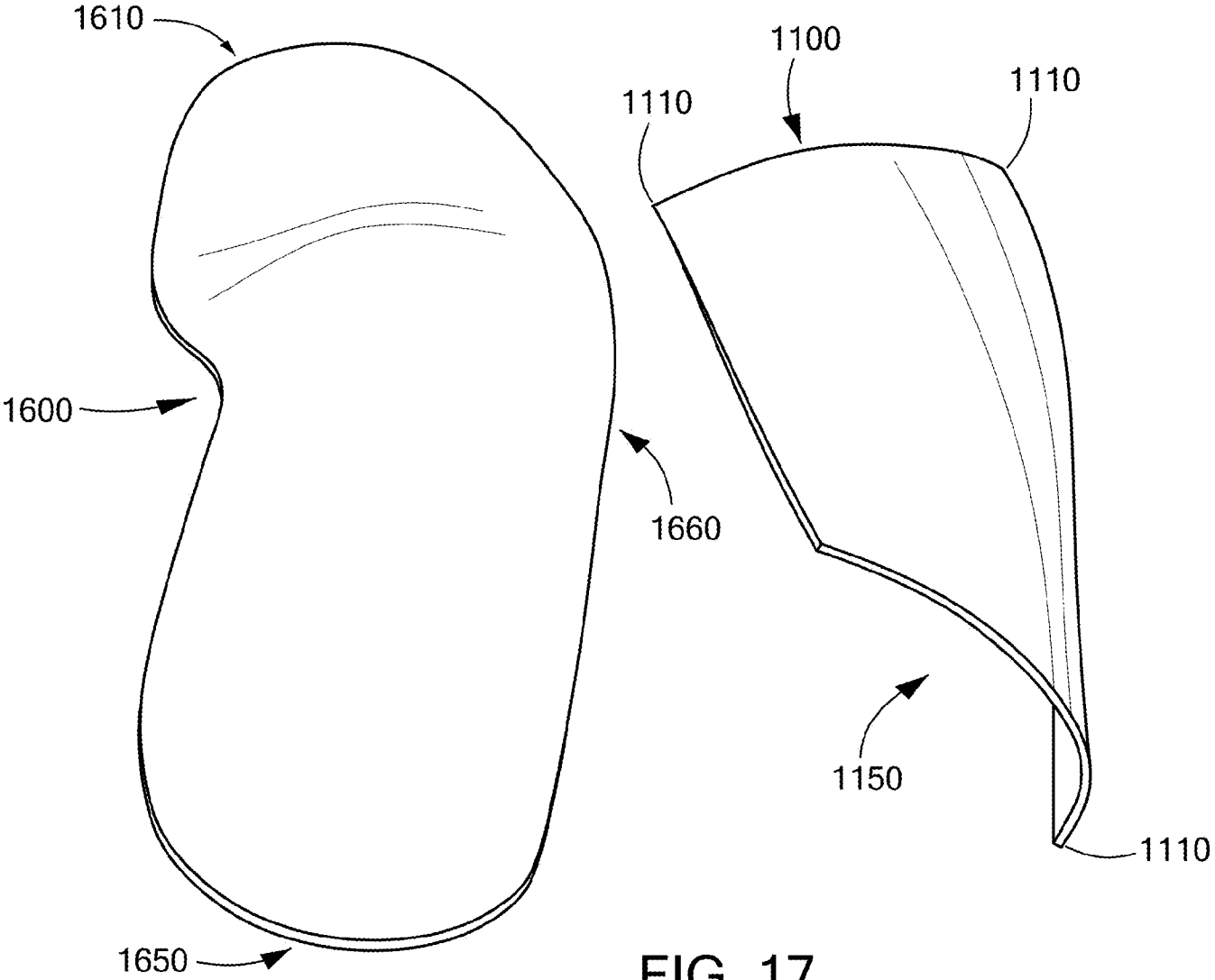
FIG. 17 shows the cantilevered twisted plate of FIG. 16 next to the twisted plate of FIG. 12 in accordance with illustrative embodiments of the invention.

FIG. 17 shows the cantilevered twisted plate 1600 next to the twisted plate 1000 in accordance with illustrative embodiments of the invention. The cantilevered twisted plate 1600 functions in a similar manner to the twisted plate 1000 shown in FIG. 12. However, the forefoot portion 1610 of the cantilevered twisted plate 1600 may have a broad contact surface, rather than specific points of contact 1110. This may be more comfortable for a user who is able to spread the pressure on the forefoot 565 of the foot 115 more evenly across the flattened contact surface area. The rearfoot portion 1650 of the cantilevered twisted plate 1600 appears to not be making contact with the ground 120. This is because the rearfoot portion 1650 has a cantilevered portion 1605 (visible in FIG. 16), stretching along a portion of a lateral side 1660, that is contacting the ground 120 underneath the cantilevered twisted plate 1600.

In some embodiments, the cantilevered twisted plate 1600 may be longer than a corresponding version of the twisted plate 1000. The cantilevered twisted plate 1600 may be configured to extend from the toes 142 all the way to the heel 505. Not all embodiments are required to fully span the length of the entire foot 115. Illustrative embodiments of any of the discussed embodiments may span a variety of lengths to terminate at or short of the toes. For example, the twisted plate 1000 may be sized to extend substantially from the posterior side 510 of the calcaneus 505 to the cuneonavicular joint 565 and calcaneocuboid joint 545. Thus, the plate 1000 does not necessarily need to be rectangular. As another example, the twisted plate 1000 may be sized to extend substantially from the posterior side 510 of the calcaneus 505 to the tarsometatarsal joints 575. As further examples, the twisted plate 1000 may be sized to terminate along the metatarsophalangeal joints 590, or it may extend the entire length of the foot 115. It should be understood that the rectangular twisted plate 1000 does not track the non-linear configuration of the aforementioned joints. Thus, in some embodiments, the end of the plate 1000 may be contoured to track the shape of the joints. A person of skill in the art will understand that the illustrated joints are not necessarily to scale, and thus, the illustrated joints are not intended to limit the shape of the plate 1000.

Nor are all embodiments required to provide a force 1220 about the entire pronation axis 400 of the foot 115. Various embodiments may provide a force 1220 only about portions of the pronation axis 400 of the foot 115. Additionally, or alternatively, illustrative embodiments may provide forces 1220 in directions other than about the pronation axis 400. For example, the metatarsophalangeal joints 590 do not play a role in the pronation axis 400, but at least part of the twisted plate 1000 may be configured to provide a force that assists bone movement about the metatarsophalangeal joints 590. Alternatively, as described above, the twisted plate 1000 may be shaped to end along the metatarsophalangeal joints 590. Cutting the plate 1000 short would allow natural flexion about the metatarsophalangeal joints 590. Accordingly, illustrative embodiments of the plate 1000 may be configured to twist about an axis that mimics the metatarsophalangeal joint axis. Illustrative embodiments may simultaneously be configured to twist about both the pronation axis 400 and the metatarsophalangeal joints 590 axis, because the metatarsophalangeal joints 590 are anterior to the relevant joints that shape the pronation axis 400.

Figure 18:
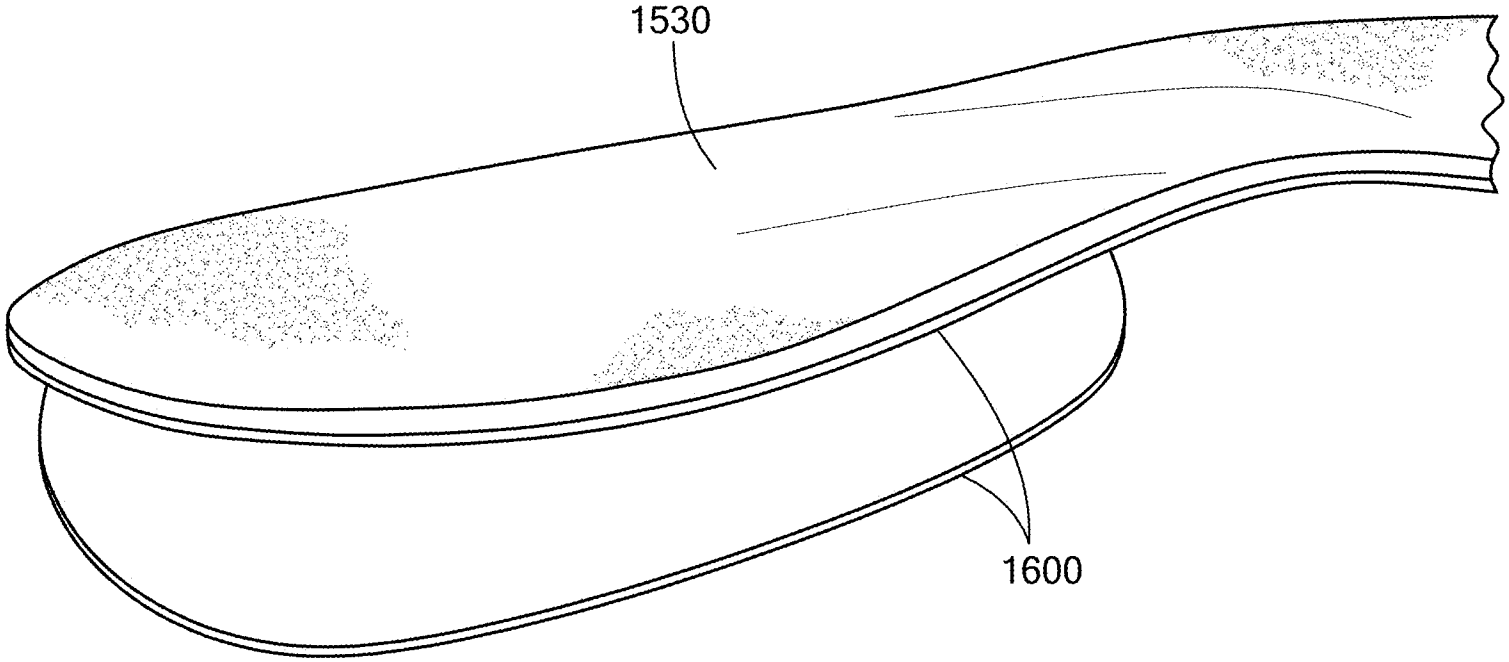
FIG. 18 shows a hard foam on the cantilevered twisted plate of FIG. 16 in accordance with illustrative embodiments of the invention.

The cantilevered twisted plate 1600 may be used in footwear, such as a shoe 1525 or insole 1500, in a manner similar to the twisted plate 1000. FIG. 18 shows a hard foam 1530 on the cantilevered twisted plate 1600 in accordance with illustrative embodiments of the invention. The hard foam 1530 may be the same type of foam 1530 discussed previously.

Figure 19:
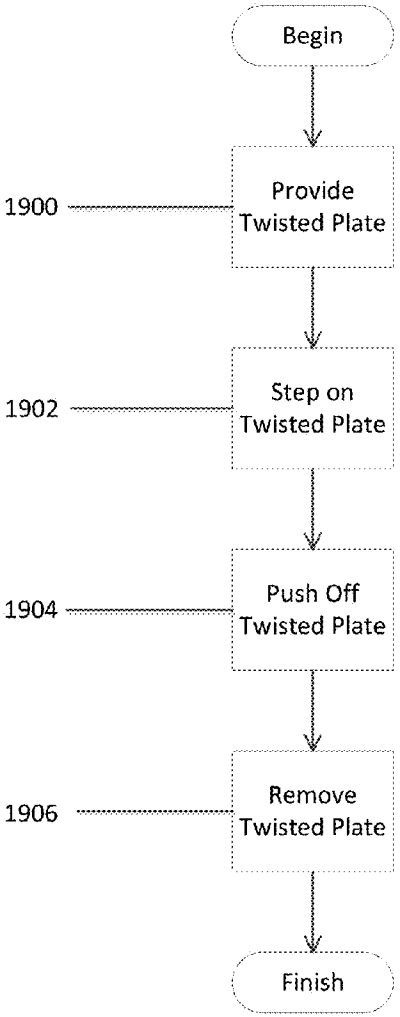
FIG. 19 shows a method of using the twisted plate in accordance with illustrative embodiments of the invention.

FIG. 19 shows a method of using the twisted plate 1000 in accordance with illustrative embodiments of the invention. It should be noted that this method is simplified from a longer process that uses the twisted plate 1000. Accordingly, the method may have other steps that those skilled in the art may use. In addition, some of the steps may be performed in a different order than that shown, or at the same time. Those skilled in the art therefore can modify the process as appropriate.

The method begins at step 1900 by providing the twisted plate 1000. As discussed above, the twisted plate 1000 may come in a number of configurations. At the time of manufacture, the sizing, length, material, force profile and shape of the plate 1000, among other things, are determined based on desired cost and performance characteristics. For example, a carbon-fiber plate 1000 that extends from the calcaneus 505 to the metatarsophalangeal joints 590 for a male having a size twelve shoe 1525 may be provided with a non-linear force 1220 profile. Furthermore, the plate 1000 may come as part of a shoe 1525, insole 1500, shoe insert or orthotic.

Step 1902 then has the user step on the twisted plate 1000 (e.g., on an apparatus, such as a foam layer, that transfers force to the plate 1000). Preferably, the plate 1000 has been sized to the user and the desired application. In some embodiments, twisted plates 1000 are sold as a set. The user may step on the plate 1000 while walking throughout the normal course of a day. Alternatively, the user may step on the shoe 1525 while running or participating in athletic activities. When the user steps down on the twisted plate

1000, potential energy is stored as the plate 1000 unwinds. As described above, during the normal gait cycle 100, the foot 115 begins to pronate 200 once contact is made with the ground 120. This pronation 200 unwinds the plate 1000 and stores potential energy. The amount of potential energy stored is dependent upon the load and the characteristics of the plate 1000 (e.g., built in non-linear force 1220).

In step 1904, the user pushes off of the twisted plate 1000. As the user continues their natural gait 100 through stance phase 105, the potential energy stored in step 1902 is released as kinetic energy, for example, during pushoff 140. As described above, the foot 115 supinates 210 after pronation 200, and the plate 1000 returns kinetic energy via a rebound that increases metabolic efficiency and may enhance mobility/performance (e.g., reduced running times). Furthermore, users may experience increased comfort as the plate 1000 assists with natural movement of the bones of the foot 115.

The method ends at step 1906 when the user removes the twisted plate 1000. Although steps 1902 and 1904 were described in the singular, it should be understood that users may take multiple steps (e.g., walk to work, participate in an athletic event). Once the user has finished with the activity, they may remove the twisted plate 1000 (e.g., take off the shoe that has the twisted plate).

Although the above discussion discloses various exemplary embodiments of the invention, it should be apparent that those skilled in the art can make various modifications that will achieve some of the advantages of the invention without departing from the true scope of the invention.

What is claimed is:

1. An apparatus for assisting movement of a foot having a pronation axis, the apparatus comprising:

a plate configured to interact with the foot, the plate having a top surface and a bottom surface, the plate having a forefoot region and a rearfoot region, the forefoot region having a forefoot lateral region and a forefoot medial region, the rearfoot region having a rearfoot lateral region and a rearfoot medial region, the plate being twisted about a plate axis that is configured to approximate the pronation axis of the foot when at rest, the forefoot lateral region, the forefoot medial region, and the rearfoot lateral region each having at least one point on the bottom surface that together share a common plane when the plate is at rest, the rearfoot medial region having at least one point on the bottom surface that is spaced from the common plane when at rest, the forefoot region being transversely concave on the bottom surface and having a first radius of curvature when at rest, the rearfoot region being transversely concave on the bottom surface and having a second radius of curvature when at rest, the first radius of curvature being greater than the second radius of curvature, the plate being biased to resist a pronatory torque applied by the foot during pronation and configured to twist, in response to the pronatory torque, about the plate axis, the plate further configured to apply a non-linear force substantially about the plate axis during foot pronation.

2. The apparatus as defined by claim 1 wherein the plate is configured to unwind during foot pronation and further configured to wind during foot supination.

3. The apparatus as defined by claim 2 wherein the plate is configured so that unwinding of the plate stores energy and so that the winding of the plate releases stored energy.

4. The apparatus as defined by claim 1 wherein the plate when at rest, is substantially flat at the forefoot region and twisted at the rearfoot region.

5. The apparatus as defined by claim 1 wherein the plate is configured to twist about the pronation axis of the foot to apply the force about the pronation axis of the foot during foot supination.

6. The apparatus as defined by claim 1 wherein the plate is further configured to provide a force that assists bone movement about the metatarsophalangeal joints.

7. The apparatus as defined by claim 1 wherein the forefoot region is configured to terminate along at least part of one of the cuneonavicular joint, the calcaneocuboid joint, the tarsometatarsal joints, and/or the metatarsophalangeal joints when cooperating with the foot.

8. The apparatus as defined by claim 1 wherein the plate is configured to provide a force against a front medial side of the foot during late pronation.

9. The apparatus as defined by claim 1 wherein the plate is in the shape of a twisted rectangle.

10. The apparatus as defined by claim 1 wherein the plate comprises carbon fiber.

11. The apparatus as defined by claim 1 further comprising a shoe insole, wherein the plate is positioned in the shoe insole.

12. The apparatus as defined by claim 1 further comprising a shoe, wherein the plate is positioned inside a sole of the shoe.

13. The apparatus as defined by claim 1 wherein foot pronation comprises composite foot motion about a subtalar joint axis, a midtarsal joint axis, and a tarsometatarsal joint axis of the foot.

14. The apparatus as defined by claim 1 wherein the foot is a human foot.

15. The apparatus as defined by claim 1 wherein the plate is configured to function as a shock absorber.

16. The apparatus as defined by claim 1 wherein the plate axis is configured to translationally and rotationally move during pronation to biomimic the pronation axis.

17. The apparatus as defined by claim 1 wherein at least a portion of the plate axis is configured to be coincident with the pronation axis.

18. The apparatus as defined by claim 1 wherein the forefoot lateral region, the forefoot medial region, and the rearfoot lateral region each have a surface area that together share the common plane when the plate is at rest.

19. The apparatus as defined by claim 1 wherein each of the at least one point of the forefoot lateral region, the forefoot medial region, and the rearfoot lateral region that share the common plane are configured to contact the ground when the plate is at rest.

* * * * *